US010968733B2

(12) United States Patent
McGinnis et al.

(10) Patent No.: US 10,968,733 B2
(45) Date of Patent: Apr. 6, 2021

(54) DOWNHOLE TEMPERATURE SENSING OF THE FLUID FLOW IN AND AROUND A DRILL STRING TOOL

(71) Applicant: National Oilwell Varco, L.P., Houston, TX (US)

(72) Inventors: Gregory T. McGinnis, Kingwood, TX (US); Alamzeb Hafeez Khan, Montgomery, TX (US); Kevin W. Clark, Montgomery, TX (US); Gregory E. Leuenberger, Spring, TX (US); Brandon C. Epperson, Magnolia, TX (US)

(73) Assignee: National Oilwell Varco, L.P., Houston, TX (US)

( * ) Notice: Subject to any disclaimer, the term of this patent is extended or adjusted under 35 U.S.C. 154(b) by 200 days.

(21) Appl. No.: 16/028,924

(22) Filed: Jul. 6, 2018

(65) Prior Publication Data

US 2018/0313204 A1 Nov. 1, 2018

Related U.S. Application Data

(62) Division of application No. 14/500,549, filed on Sep. 29, 2014, now Pat. No. 10,036,241.

(60) Provisional application No. 61/883,578, filed on Sep. 27, 2013.

(51) Int. Cl.
*E21B 47/07* (2012.01)
*E21B 47/01* (2012.01)

(52) U.S. Cl.
CPC ..... *E21B 47/07* (2020.05); *E21B 47/01* (2013.01)

(58) Field of Classification Search
CPC ..... E21B 47/06; E21B 47/07; E21B 47/065; E21B 47/01
See application file for complete search history.

(56) References Cited

U.S. PATENT DOCUMENTS 2,191,765 A * 2/1940 Lohman ..... E21B 47/07 374/185
2,676,489 A * 4/1954 Basham ..... E21B 47/07 374/112
3,327,527 A * 6/1967 Arps ..... E21B 47/07 73/152.03
3,668,927 A * 6/1972 Howell ..... E21B 47/07 73/152.13
3,802,269 A * 4/1974 Cooper ..... E21B 47/07 374/104

(Continued)

*Primary Examiner* — Steven A MacDonald
(74) *Attorney, Agent, or Firm* — Conley Rose, P.C.

(57) ABSTRACT

Temperature sensing devices and methods for determining downhole fluid temperature at a drill string in a borehole while drilling are disclosed. The device includes a temperature sensor capable of detecting and measuring rapid temperature changes and may be used to sense the temperature of fluid inside or outside the drill string. In addition, the device includes a thermal conductor that receives and secures the temperature sensor; the thermal conductor is in turn received and secured in a thermal insulator that provides a thermal barrier. In an embodiment, the device is disposed in a channel within an outer diameter of the drill string such that the device is protected from the side wall of the borehole and drilling fluid and cuttings can pass through the channel without becoming packed around the temperature sensor.

20 Claims, 14 Drawing Sheets

(56) References Cited

U.S. PATENT DOCUMENTS

| | | | | | |
|---|---|---|---|---|---|
| 4,417,470 | A * | 11/1983 | McCracken | E21B 47/07 | 374/136 |
| 4,884,071 | A * | 11/1989 | Howard | E21B 47/13 | 340/854.8 |
| 5,136,525 | A * | 8/1992 | Cloud | E21B 47/07 | 702/9 |
| 5,829,520 | A * | 11/1998 | Johnson | E21B 43/086 | 166/250.01 |
| 7,644,760 | B2 * | 1/2010 | Woloson | E21B 47/07 | 166/250.01 |
| 2006/0065395 | A1 * | 3/2006 | Snell | E21B 41/0078 | 166/255.2 |
| 2006/0266518 | A1 * | 11/2006 | Woloson | E21B 47/07 | 166/250.01 |
| 2014/0231142 | A1 * | 8/2014 | Poitzsch | E21B 10/00 | 175/50 |

* cited by examiner

DOWNHOLE TEMPERATURE SENSING OF THE FLUID FLOW IN AND AROUND A DRILL STRING TOOL

CROSS-REFERENCE TO RELATED APPLICATIONS

The present application is a divisional of U.S. non-provisional application Ser. No. 14/500,549 filed Sep. 29, 2014, entitled "Downhole Temperature Sensing of the Fluid Flow in and Around a Drill String Tool," which claims benefit of U.S. provisional Application No. 61/883,578, filed Sep. 27, 2013, entitled "Downhole Temperature Sensing of the Fluid Flow in and Around a Drill String Tool," all of which are incorporated herein by reference in their entirety for all purposes.

STATEMENT REGARDING FEDERALLY SPONSORED RESEARCH OR DEVELOPMENT

Not applicable.

BACKGROUND

The present disclosure relates generally to methods and apparatus for sensing temperature proximate a drill string tool conveyed in a borehole. The present disclosure relates more particularly to methods and apparatus for sensing the temperature of drilling fluid in the inner diameter, or flow-bore, of the drill string tool or in the annulus between the outer diameter of the drill string tool and the borehole.

To recover hydrocarbons from subterranean formations, wells are generally constructed by drilling into the formation using a rotating drill bit attached to the lower end of an assembly of drill pipe sections connected end-to-end to form a drill string. In some cases the drill string and bit are rotated by a drilling table at the surface, and in other cases the drill bit may be rotated by a downhole motor within the drill string above the bit, while remaining portions of the drill string remain stationary. In most cases, the downhole motor is a progressive cavity motor that derives power from drilling fluid (sometimes referred to as mud) pumped from the surface, through the drill string, and then through the motor (hence the motor may also be referred to as a mud motor).

Modern oil field operations demand a great quantity of information relating to the parameters and conditions encountered downhole. Such information typically includes borehole environmental information, such as temperature, pressure, etc., and drill string operational information. Temperature is a common downhole reading; however, sensors are often not placed optimally for temperature measurements. Sensors are typically disposed on the downhole tools and measure the temperature of the tool housing and do not track temperature changes very well. Alternatively, temperature sensors may be placed at the point of interest; however, the point of interest in a borehole is in the path of the fluid flowing either through the internal diameter (ID) of the drill pipe or through the annulus formed about the outer diameter (OD) of the pipe. In either case, an exposed temperature probe is difficult to handle and subject to erosion from the fluid flowing at hundreds of gallons per minute (GPM).

There is a need to measure small temperature changes in the borehole while drilling. Temperature changes on the order of tenths of a degree are very informative of the borehole environment and provide a method for predicting the events that will follow. Temperature has an impact on all downhole readings and being able to detect small changes in temperature allows the exact temperature coefficient in every calculation be determined, which helps correctly depict the temperature reading by subtracting the temperature effects from other readings. However, commonly used temperature measuring systems can be inaccurate due to a margin of error from +/−2° C. up to +/−5° C. at higher temperatures, non-optimal sensor positioning as previously discussed, temperature dissipation in the body in which the housing of the downhole tools acts as a shield against rapid temperature changes and delays the sensor's ability to detect rapid temperature changes, and low precision of the temperature sensor where the sensor resolution is limited to 1.0 or 0.5° C. There is a further need to prevent drilling fluid and cuttings from becoming packed around the temperature sensors. Drilling fluid acts as a thermal insulator and may prevent true temperature measurement readings as the temperature fluctuates.

BRIEF SUMMARY OF THE DISCLOSURE

In one embodiment, a temperature sensing device for determining downhole fluid temperature at a drill string in a borehole includes a resistance temperature sensor coupled with thermally conductive epoxy to an internal surface of a cylindrical thermal conductor and a cylindrical thermal insulator having a cylindrical cavity configured to sealingly house the thermal conductor. In addition, the device includes a plurality of seals disposed between an outer cylindrical surface of the thermal conductor and an inner cylindrical surface of the thermal insulator and between an outer cylindrical surface of the thermal insulator and an inner surface of a cavity in the drill string. The device further includes a first retaining ring disposed in a groove formed in the inner surface of the thermal insulator and a second retaining ring disposed in a groove formed in the inner surface of the cavity in the drill string. In some embodiments, the thermal conductor internal surface is disposed proximate an outer surface of the drill string to sense the fluid temperature outside the drill string. In other embodiments, the thermal conductor internal surface is disposed proximate an inner surface of the drill string to sense the fluid temperature inside the drill string.

In one embodiment, a method of determining downhole fluid temperature at a drill string in a borehole includes coupling a resistance temperature sensor to an internal surface of a thermal conductor with thermally conductive epoxy and inserting the thermal conductor into a cylindrical cavity of a cylindrical thermal insulator. In addition, the method includes installing a plurality of seals between an outer cylindrical surface of the thermal conductor and an inner cylindrical surface of the thermal insulator and between an outer cylindrical surface of the thermal insulator and an inner surface of a cavity in the drill string. The method further includes installing a first retaining ring in a groove formed in the inner surface of the thermal insulator and installing a second retaining ring in a groove formed in the inner surface of the cavity in the drill string. In some embodiments, the method may further include disposing the thermal conductor internal surface proximate an outer surface of the drill string to sense the fluid temperature outside the drill string. In other embodiments, the method may further include disposing the thermal conductor internal surface proximate an inner surface of the drill string to sense the fluid temperature inside the drill string.

In an embodiment, a temperature sensing device for determining downhole fluid temperature at a drill string in a borehole includes a thermal insulator to be received and secured in a cavity in the drill string, a thermal conductor to be received and secured in the thermal insulator, and a temperature sensor to be received and secured in the thermal conductor and disposed adjacent a first opening in the cavity. In addition, the device includes a thermally insulating plug to be received in a second opening in the cavity and to be secured in the cavity to retain the thermal insulator and the thermal conductor. Moreover, the thermal insulator provides a first thermal barrier between the thermal conductor and the drill string and the thermally insulating plug provides a second thermal barrier between the thermal conductor and the drill string. In some embodiments, the device further includes a thermally insulating ring disposed between the plug and the thermal conductor to provide the second thermal barrier. In some embodiments, the second thermal barrier is disposed in the cavity such that the cavity is separated into a first sensor portion and a second portion.

In one embodiment, a temperature sensing device for determining downhole fluid temperature at a drill string in a borehole includes a thermal insulator to be received and secured in a cavity in the drill string, a thermal conductor to be received and secured in the thermal insulator, a temperature sensor to be received and secured in the thermal conductor and disposed adjacent a first opening in the cavity, and an inner cavity portion disposed radially inward of the thermal insulator and the thermal conductor. In addition, the thermal insulator provides a first thermal barrier between the thermal conductor and the drill string and the inner cavity portion provides a second thermal barrier between the thermal conductor and the drill string. In some embodiments, air in the inner cavity thermally insulates the thermal conductor from the drill string at the second thermal barrier. In some embodiments, a thermal conduction path to the temperature sensor disposed outside of the inner cavity portion. In some embodiments, the device is disposed in a channel on the drill string and within an outer diameter of the drill string.

In one embodiment, a temperature sensing device for determining downhole fluid temperature at a drill string in a borehole includes a housing having a cylindrical cavity, a resistance temperature sensor coupled with thermally conductive epoxy to an internal surface of the cavity, and a plurality of stabilizers configured to secure the housing within the drill string. In some embodiments, the resistance temperature sensor is further coupled with potting to the internal surface of the cavity. In some embodiments, the housing may be steel and have a coating to prevent erosion. In some embodiments, the stabilizers have a tapered outer surface.

Embodiments described herein comprise a combination of features and advantages intended to address various shortcomings associated with certain prior devices, systems, and methods. The foregoing has outlined rather broadly the features and technical advantages of the disclosed embodiments such that the detailed description that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the disclosed embodiments. It should also be realized by those skilled in the art that such equivalent constructions do not depart from the spirit and scope of the disclosure as set forth in the appended claims.

BRIEF DESCRIPTION OF THE DRAWINGS

For a detailed description of the disclosure, reference will now be made to the accompanying drawings in which.

DETAILED DESCRIPTION

Figure 1:
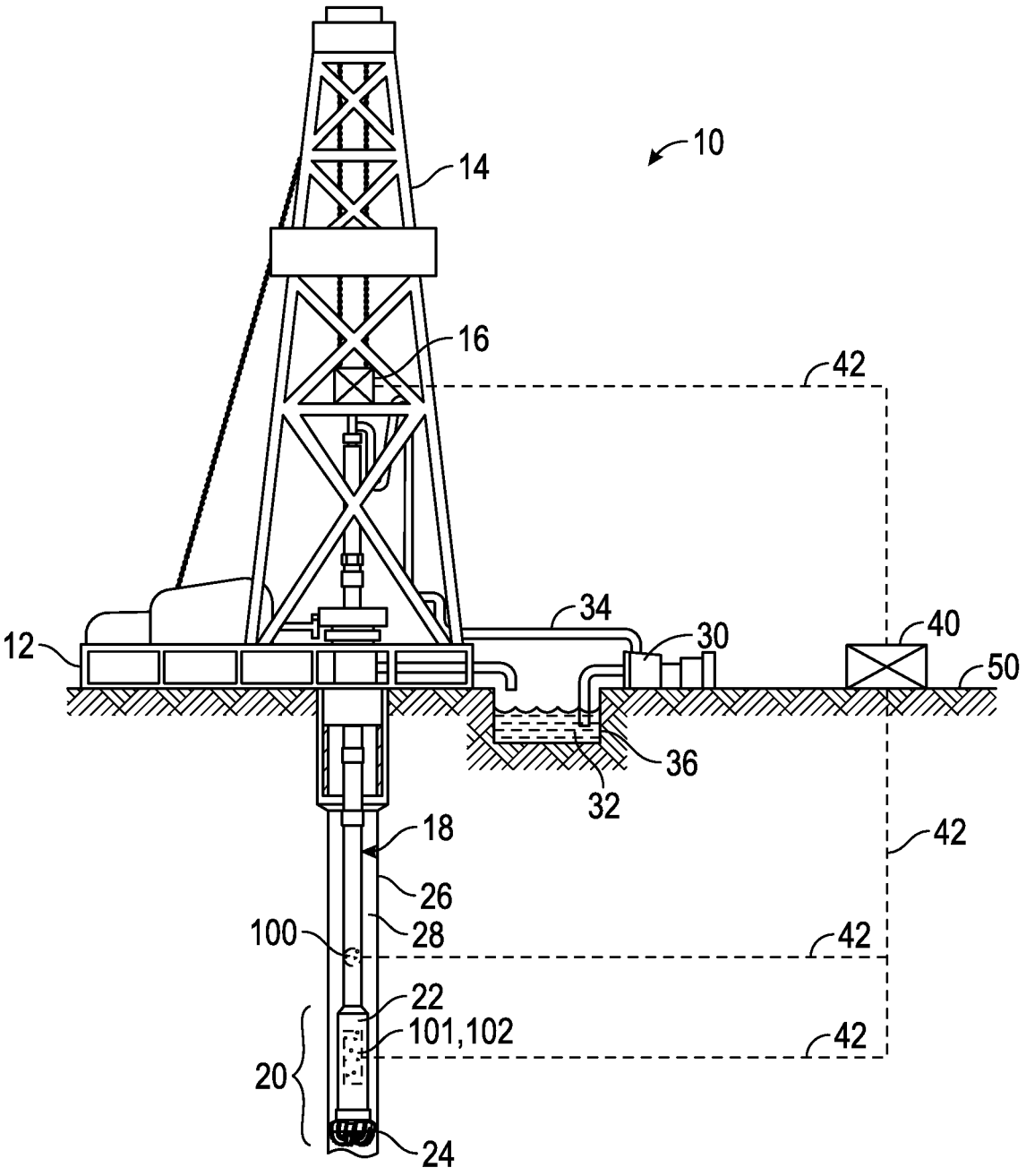
FIG. 1 is a schematic view of a drilling system including an embodiment of a system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosures, including the claims, is limited to that embodiment.

Certain terms are used throughout the following description and claims to refer to particular system components. This document does not intend to distinguish between components that differ in name but not function. Moreover, the drawing figures are not necessarily to scale. Certain features of the disclosure may be shown exaggerated in scale or in somewhat schematic form, and some details of conventional elements may not be shown in the interest of clarity and conciseness. Further, some drawing figures may depict vessels in either a horizontal or vertical orientation; unless otherwise noted, such orientations are for illustrative purposes only and is not a required aspect of this disclosure.

In the following discussion and in the claims, the terms "including" and "comprising" are used in an open-ended fashion, and thus should be interpreted to mean "including, but not limited to . . . ." Also, the terms "couple," "attach," "connect" or the like are intended to mean either an indirect or direct mechanical or fluid connection, or an indirect, direct, optical or wireless electrical connection. Thus, if a first device couples to a second device, that connection may be through a direct mechanical or electrical connection, through an indirect mechanical or electrical connection via other devices and connections, through an optical electrical connection, or through a wireless electrical connection. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis. Any reference to up or down in the description and the claims will be made for purpose of clarification, with "up," "upper," "upwardly," or "upstream" meaning toward the surface of the well and with "down," "lower," "downwardly," or "downstream" meaning toward the terminal end of the well, regardless of the well bore orientation. In some applications of the technology, the orientations of the components with respect to the surroundings may be different. For example, components described as facing "up," in another application, may face to the left, may face down, or may face in another direction.

In various embodiments to be described in detail below, a system and process for determining the temperature of the drilling fluid includes the use of resistance temperature detectors (RTD) in accordance with the principles of the present disclosure. In certain embodiments, the temperature of the drilling fluid in the inner diameter (ID) of the drill string tool is determined and in certain other embodiments, the temperature of the drilling fluid in the borehole annulus or outer diameter (OD) of the drill string tool is determined.

Referring now to FIG. 1, which shows a drilling system 10 including sensor assembly 100 in accordance with various embodiments. As shown, the drilling system 10 is a land based drilling system, but could also be water based. A drilling platform 12 supports a drilling rig 14 having a hoisting device 16 for raising and lowering a drill string 18 having a central axis 11. The drill string 18 comprises a bottom hole assembly 20 having a downhole tool 22 and a drill bit 24 driven by a downhole motor and/or rotation of the drill string 18. As bit 24 rotates, it creates a borehole 26 that passes through various subsurface formations. A pump 30 circulates drilling fluid 32 through a feed pipe 34, downhole through the inner diameter of drill string 18, through orifices in drill bit 24, back to the ground surface 50 via the annulus 28 around the drill string 18, and into a drilling fluid reservoir 36, such as a mud tank or retention pit. The drilling fluid transports cuttings from the borehole into the reservoir 34 and aids in maintaining the borehole integrity.

In addition to the sensor assembly 100, there may be one or more additional sensors 101 located proximate to, or at distances from, the sensor assembly 100. The additional sensors 101 may be any suitable sensor for determining one or more downhole parameters, such as, but not limited to, a gyroscopic sensor, a strain gauge sensor, a pressure sensor, a temperature sensor, a logging tool, a measurement while drilling tool, or other sensor. The additional sensors 101 may be used independently or in combination with the sensor assembly 100.

The drilling system 10 may further comprise a memory element 102, where the data collected by the sensors 100, 101 is stored for retrieval at the surface. This stored data may be downloaded from the memory 102 when the downhole tool 22 is brought to the surface 50 at the end of drilling operations.

Drilling system 10 further comprises a controller 40, which sends and receives signals about the drilling system 10 via one or more communication links 42. The communication link 42 may be any communications system known in the art including, but not limited to, a wired pipe system, a mud-pulse system, an electromagnetic telemetry system, a radio frequency transmission system, or an acoustic transmission system.

The controller 40 may be used to control the equipment at the drilling system 10, such as, but not limited to, the downhole tool 22, the hoisting device 16, one or more pumps 30, the sensor assembly 100, and the additional sensors 101. Further, the controller 40 may receive data from the sensor assembly 100, the additional sensors 101, and/or the memory 102 at a data transmission rate of 0.4 Hz to 800 Hz depending upon the speed of the communications link 42. The data received by the controller 40 may be used to evaluate and/or manipulate drilling system operations.

In the present embodiment, the sensor assembly 100 is shown and described as being located within the drill string 18. The sensor assembly 100 may be located at any suitable downhole location including, but not limited to, in or about a drill collar, in an annulus of a drill collar, in a sub, in or about a tool body, or other downhole locations. Further, the sensor assembly 100 may be located in more than one downhole location, as will be described in more detail below.

Figure 2:
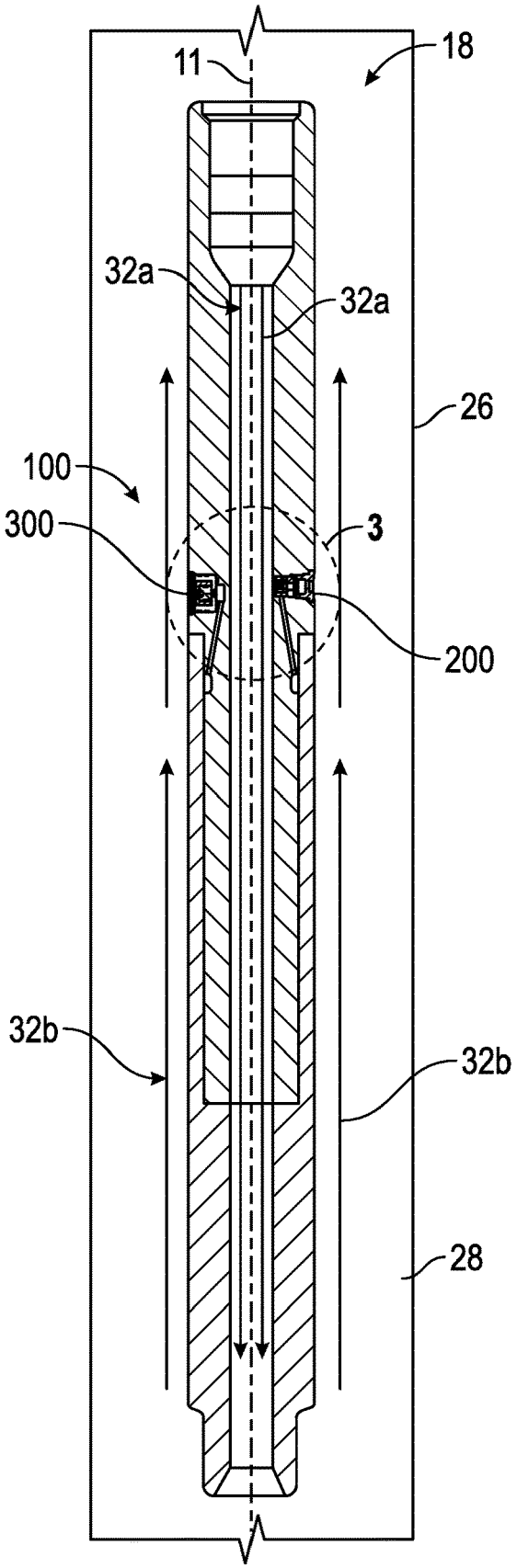
FIG. 2 is an enlarged cross-sectional schematic view of a portion of a first embodiment of the system shown in FIG. 1.

Referring now to FIG. 2, which shows an enlarged schematic view of a portion of a first embodiment of the drill string 18 of drilling system 10 shown in FIG. 1 having sensor assembly 100. The sensor assembly 100 may comprise either one sensor 200 configured to measure the temperature of drilling fluid 32*a* flowing down the inner diameter of the drill string 18 ("ID sensor 200") or one sensor 300 configured to measure the temperature of the drilling fluid 32*b* flowing up the annulus 28 or outer diameter of the borehole 26 ("OD sensor 300"); or sensor assembly 100 may comprise two sensors 200, 300 configured to measure the temperature of both the drilling fluid 32*a* flowing down the inner diameter of the drill string 18 (ID sensor 200) and the drilling fluid 32*b* flowing up the annulus 28 (OD sensor 300) as shown in the present embodiment. Further, more than one sensor assembly 100 may be employed in a drilling system 10 at various locations to measure the temperature of the drilling fluid 32 at different locations within the drill string 18 and/or in the annulus 28. It should be understood that other downhole fluids can take the place of the drilling fluid in the embodiments described herein, including but not limited to, completion fluids, servicing fluids, formation fluids, production fluids, and other downhole fluids.

Figure 3:
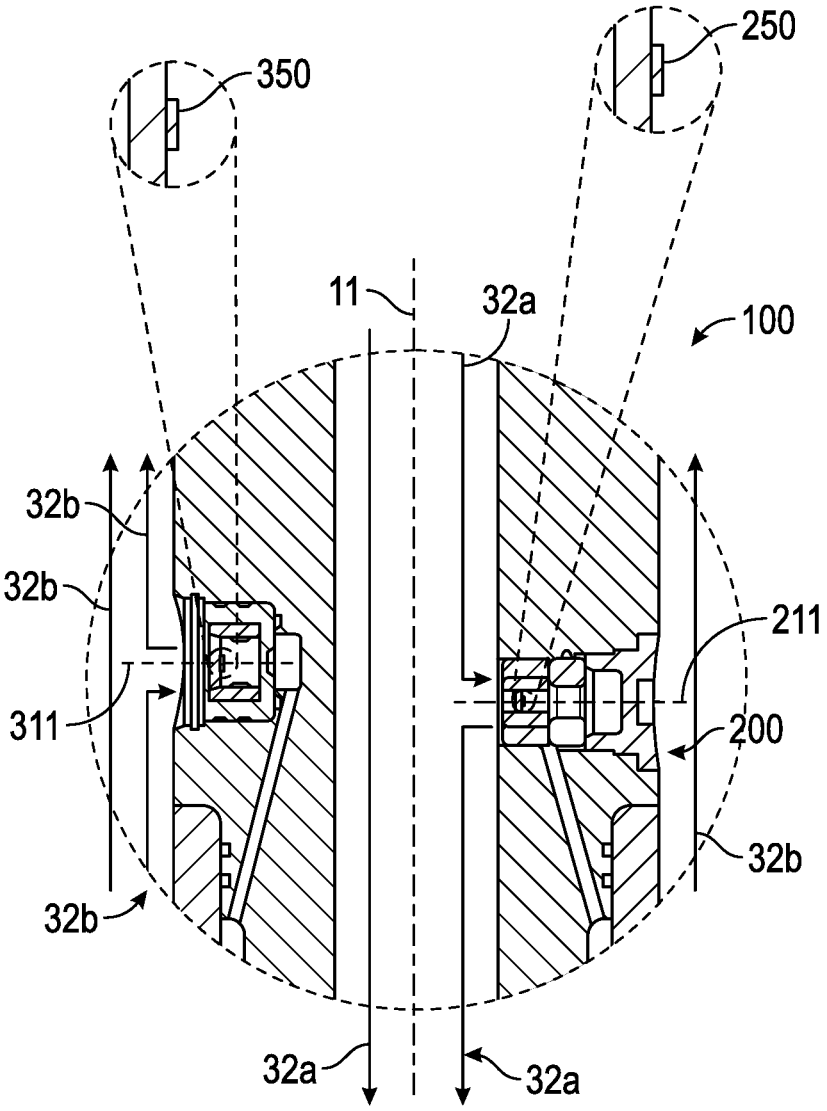
FIG. 3 is an enlarged schematic view of a portion of the system shown in FIG. 2.

Referring now to FIG. 3, which shows an enlarged view of section 3 depicted in FIG. 2 and includes sensor assembly 100 having an ID sensor 200 with central axis 211 and an OD sensor 300 with central axis 311. Central axes 211, 311 are orthogonally positioned in relation to the central axis 11 of the drill string 18. In the present embodiment, and for simplicity and ease of illustration, ID sensor 200 is positioned axially proximate OD sensor 300. However, in other embodiments, ID sensor 200 may be positioned an axial distance away from OD sensor 300. Each sensor 200, 300 comprises a resistance temperature detector (RTD) 250, 350, respectively, as shown in the enlarged views of sensors 200, 300. In general, RTDs 250, 350 can be any resistance temperature detector known in the art including, but not limited to, the Leaded Platinum Temperature Sensor available from Vishay Intertechnology, Inc.

Figure 4:
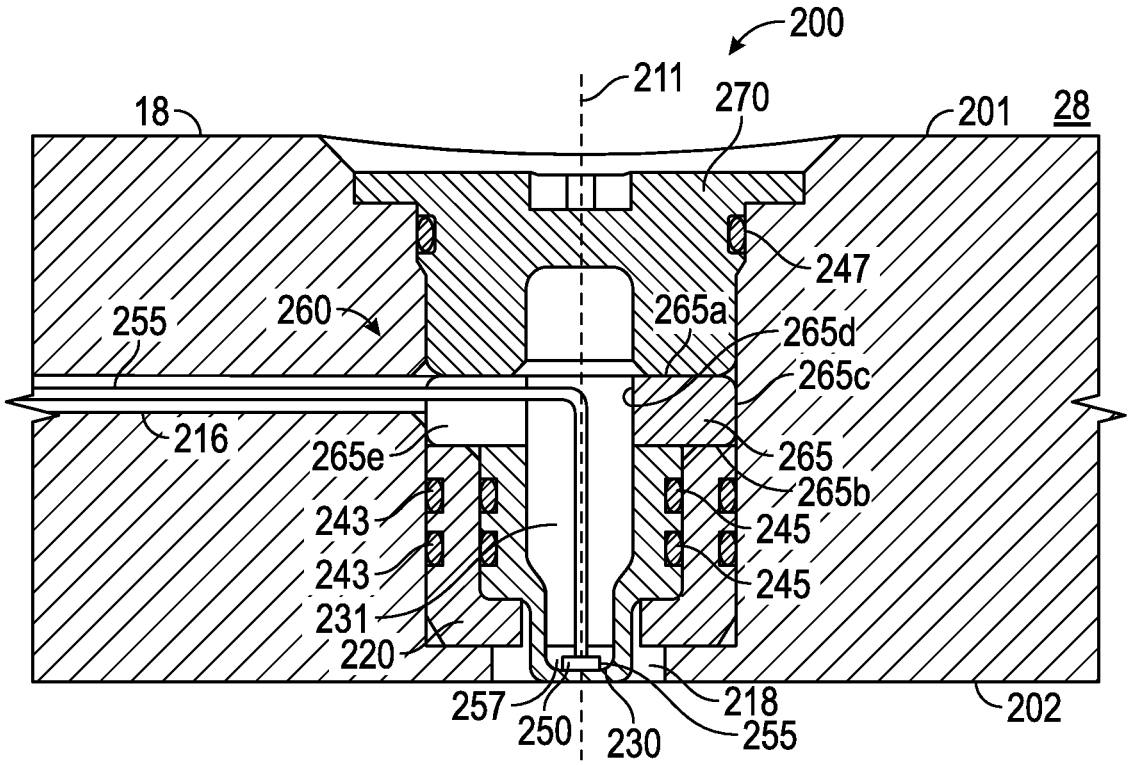
FIG. 4 is an enlarged schematic view of a first alternative inner diameter sensor of the system shown in FIG. 3.
Figure 4A:
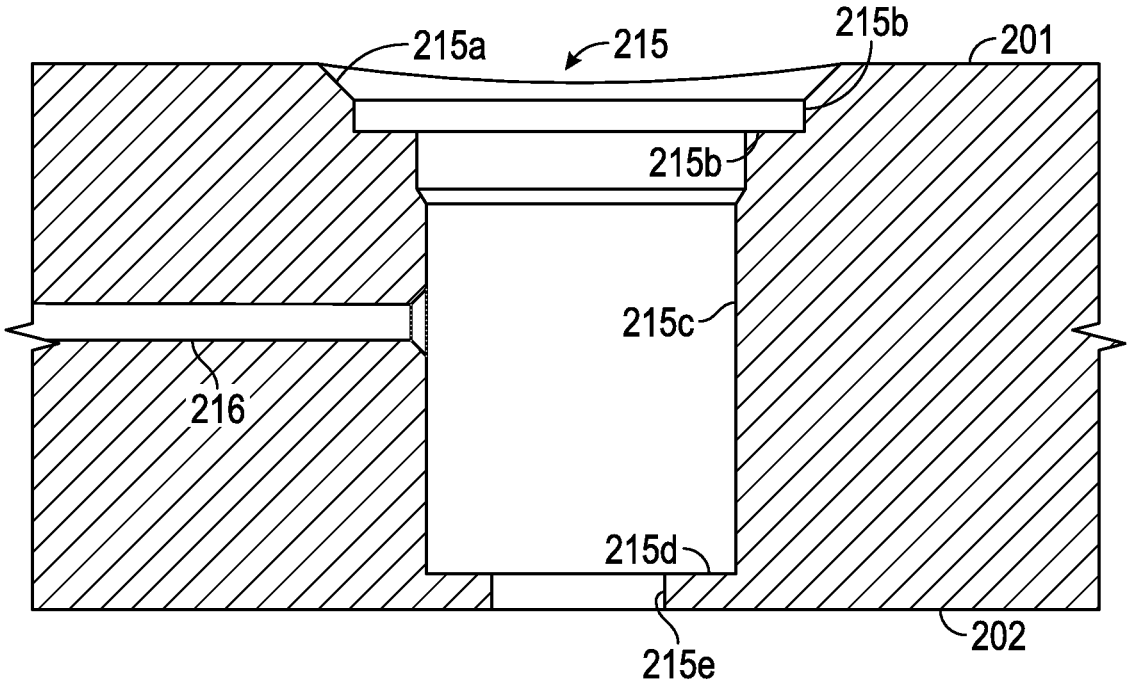
FIG. 4A is an isolated view of a cavity of the inner diameter sensor shown in FIG. 4.

Referring now to FIGS. 4 and 4*a*, an enlarged schematic view of a first alternative ID sensor 200 installed in drill string 18 is shown. Drill string 18 further comprises a through bore or cavity 215 that extends from the OD 201 of drill string 18 to the ID 202 of drill string, where cavity 215 has a central axis coaxial with the central axis 211 of sensor 200. The diameter of cavity 215 generally decreases from the OD 201 to the ID 202 of the drill string 18 and comprises a tapered opening or sloped portion 215*a* that angles radially inward toward central axis 211 from OD 201 to outer shoulder 215*b*. Upper cylindrical portion 215*c* of cavity 215 extends axially from the outer shoulder 215*b* toward ID 202 to inner shoulder 215*d*. Lower cylindrical portion or opening 215*e* extends axially from ID 202 to inner shoulder 215*d*. Drill string 18 further comprises a conduit 216 extending away from cavity 215 toward controller 40. At least a portion of upper cylindrical portion 215*c* of cavity 215 below outer shoulder 215*b* and above conduit 216 is threaded.

Figure 4B:
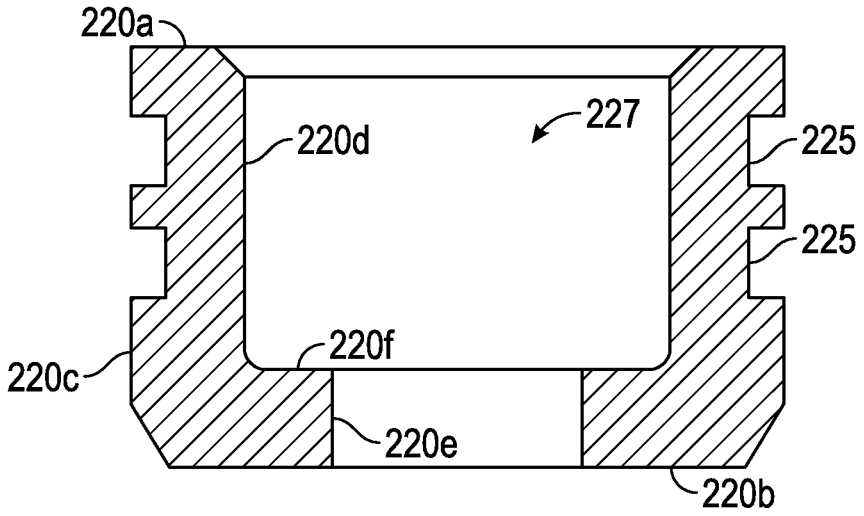
FIG. 4B is an isolated view of an insulator of the inner diameter sensor shown in FIG. 4.
Figure 4C:
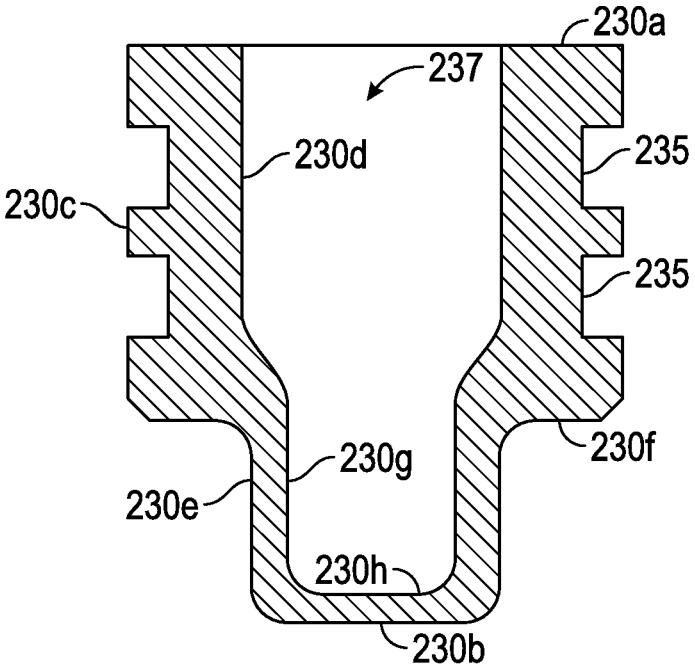
FIG. 4C is an isolated view of a conductor of the inner diameter sensor shown in FIG. 4.

Referring now to FIGS. 4, 4*a*, and 4*b*, sensor 200 comprises a thermal insulator 220, thermal conductor 230, seals 243, 245, 247, a RTD 250, thermally conductive epoxy 257, and a retention assembly 260. Thermal insulator 220 is generally cylindrical, has a central axis 211, an upper end 220*a* opposite a lower end 220*b*, an external cylindrical surface 220*c* coaxial with an internal cylindrical surface 220*d* and with central axis 211, a through hole 220*e* coaxial with central axis 211, an internal shoulder 220*f*, and two circumferential channels or grooves 225. External cylindrical surface 220*c* extends axially from upper end 220*a* to lower end 220*b*. Internal cylindrical surface 220*d* with internal shoulder 220*f* form a cavity 227 that is coaxial with central axis 211, and extends axially from internal shoulder 220*f* to upper end 220*a*. Through hole 220*e* extends axially from internal shoulder 220*f* to lower end 220*b* and has a diameter less than the diameter of internal cylindrical surface 220*d*. The two grooves 225, axially spaced apart from each other, are disposed on and coaxial with external cylindrical surface 220*c* of thermal insulator 220. Thermal insulator 220 may be made of any suitable thermally insulative material known in the art, including but not limited to ceramics, rubber, polymers, polyetheretherketone (PEEK), and thermoplastics.

Thermal insulator 220 is disposed in cavity 215 of the drill string 18 such that lower end 220*b* of insulator 220 is in contact with inner shoulder 215*d* of cavity 215, and external cylindrical surface 220*c* of insulator 220 is sealingly coupled to a portion of upper cylindrical portion 215*c* of cavity 215. The thermal insulator 220 acts as a thermal barrier, resisting or blocking heat transfer from the drill string 18 to the interior or cavity 227 of the thermal insulator 220. A seal 243 is disposed in each groove 225 to seal the internal components from the pressure and fluid of the drilling fluid 32 during operation. In general, seals 243 can be any O-ring seal and/or back up ring known in the art.

Referring now to FIGS. 4 and 4*a*-4*c*, thermal conductor 230 is generally cylindrical, has a central axis 211, an upper end 230*a* opposite a lower end 230*b*, an upper external cylindrical surface 230*c* coaxial with an upper internal cylindrical surface 230*d* and with central axis 211, a lower external cylindrical surface 230*e* coaxial with a lower internal cylindrical surface 230*g* and with central axis 211, an internal bottom surface 220*h*, an external shoulder 230*f*, and two circumferential channels or grooves 235. Upper external cylindrical surface 230*c* extends axially from upper end 230*a* to external shoulder 230*f*. External shoulder 230*f* extends radially inward toward central axis 211 from upper external cylindrical surface 230*c* to lower external cylindrical surface 230*e*. The intersection of upper external cylindrical surface 230*c* and external shoulder 230*f* may follow any geometry including but not limited to orthogonal, rounded, curved, or slanted (shown). Lower external cylindrical surface 230*e* extends axially from external shoulder 230*f* to lower end 230*b*.

Upper external cylindrical surface 230*c* has a diameter greater than the diameter of lower external cylindrical surface 230*e*, and upper internal surface 230*d* has a diameter greater than the diameter of lower internal surface 230*g*. Internal cylindrical surfaces 230*d*, 230*g* with internal bottom surface 230*h* form a cavity or inner bore 237 that is coaxial with central axis 211, and extends from internal bottom surface 230*h* upward to upper end 230*a* while flaring outward such that lower internal cylindrical surface 230*g* forms the portion of bore 237 that has a smaller diameter than upper internal surface 230*d*, which forms the portion of bore 237 that has a larger diameter. The two grooves 235, axially spaced apart from each other, are disposed on and coaxial with upper external cylindrical surface 230*c* of thermal conductor 230. Thermal conductor 230 may be made of any suitable thermally conductive material known in the art, including but not limited to metals. The thermal conductance of the thermal conductor 230 material is preferably higher than the thermal conductance of the main tool body. Furthermore, the thickness of the lower end 230*b* of conductor 230 to the internal bottom surface 230*h* can be adjusted based on the erosion testing results of the material selected for the conductor 230. Materials more resistant to erosion may allow for a thinner lower end 230*b* of conductor 230. The thinner the lower end 230*b* can be, the less time it will take to see the accurate temperature reading. Further, the more surface area that can be provided by the thermal conductor 230 to be in contact with the drilling fluid 32*a*, the more the drilling fluid 32*a* flow can affect the sensors reading.

Thermal conductor 230 is coupled to the thermal insulator 220 such that external shoulder 230*f* of conductor 230 is in contact with internal shoulder 220*f* of insulator 220; upper external cylindrical surface 230*c* of conductor 230 is sealingly coupled to internal cylindrical surface 220*d* of insulator 220; and upper end 220*a* of insulator 220 is flush with upper end 230*a* of conductor 230. Further, thermal conductor lower end 230*b* and a portion of lower external surface 230*e*, and thus a portion of inner bore 237, extend through hole 220*e* of thermal insulator 220. The thermal insulator 220 acts as a thermal barrier, resisting or blocking heat transfer between the drill string 18 and thermal conductor 230. A seal 245 is disposed in each groove 235 to seal the internal components from the pressure and fluid of the drilling fluid 32 during operation. In general, seals 245 can be any O-ring seal and/or back up ring known in the art. Further, through hole 220*e* of insulator 220 may be in contact with lower external surface 230*e* of conductor 230, but need not be.

A recessed portion or circular channel 218 is formed between lower cylindrical portion 215*e* of cavity 215 and lower external cylindrical surface 230*e* of conductor 230 and connected by lower end 220*b* of insulator 220. Lower end 230*b* of conductor 230 may protrude beyond the surface of ID 202 of drill string 18; lower end 230*b* more preferably is flush with or below the ID 202 of drill string 18. During operation, the drilling fluid 32*a* flowing down the inner diameter 202 of the drill string 18 flows into and around channel 218 as well as over lower end 230*b* of conductor 230. The channel 218 and protruding lower end 230*b* of conductor 230 provide an increased surface area for the drilling fluid 32*a* to contact on the conductor 230 and subsequently, the RTD 250. The increased surface area allows the RTD 250, via the conductor 230, to respond quickly to changes in drilling fluid 32*a* temperature. Further, the small profile of the conductor 230 minimizes the amount of conductor material and in addition to the insulation (i.e., insulator 220) surrounding the conductor 230, prevents the dissipation of heat from the drilling fluid 32*a* to the rest of the drill string component 18.

Referring to FIG. 4, an RTD 250 is adhered to the internal bottom surface 230*h* of conductor 230 with thermally conductive epoxy 257. A thermal conduction path is formed between the drilling fluid 32*a* and the RTD 250 through the thermal conductor 230 and the thermally conductive epoxy 257. Epoxy 257 allows sensor 200 to withstand vibrations of the drill string 18 during operations; further strain relief may be added to the RTD 250 using a potting. The thermal epoxy 257 further allows the RTD 250, via the conductor 230, to respond quickly to changes in drilling fluid 32*a* temperature. The RTD 250 comprises leads or wires 255, which are routed up through inner bore 237 of the thermal conductor 230 forming a hollow annulus 231 between the wires 255 and the thermal conductor inner cylindrical surfaces 230*d*, 230*g*, then through a passage 265*e* in split ring 265 (to be described in more detail below), and then into the conduit 216. The RTD wire 255 is in communication with controller 40.

Figure 4D:
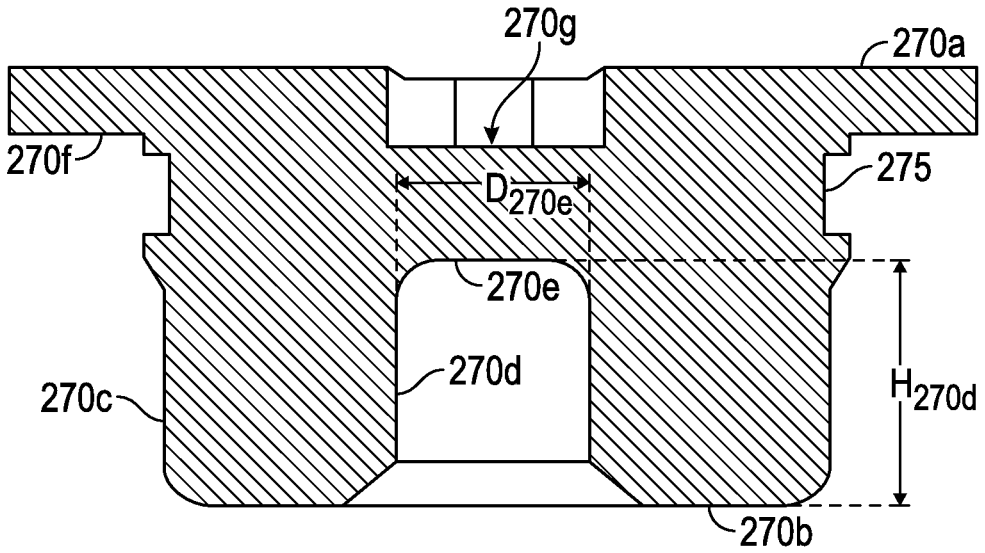
FIG. 4D is an isolated view of a threaded plug of the inner diameter sensor shown in FIG. 4.

Referring now to FIGS. 4 and 4*d*, retention assembly 260 comprises a thermally insulating split ring 265 and a threaded plug 270. Split ring 265 is generally cylindrical, has a central axis 211, an upper end 265*a* opposite a lower end 265*b*, an external surface 265*c* coaxial with an internal surface 265*d* and with central axis 211, and a passage 265*e*. Passage 265*e* of split ring 265 is aligned with conduit 216 and allows the RTD wires 255 to pass through the split ring 260 and out through conduit 216. Split ring 265 may be made of any suitable thermally insulative material known in the art, including but not limited to ceramic, polymers, or metals. The split ring 265 is disposed in cavity 215 such that upper end 265*a* of split ring 265 is aligned and in contact with the upper ends 220*a*, 230*a* of the thermal insulator 220 and thermal conductor 230, respectively, and external surface 265*c* of split ring 265 is in contact with a portion of outer cylindrical portion 215*c* of cavity 215. The thermally insulating split ring 265 acts as a thermal barrier, resisting or blocking heat transfer between the thermal conductor 230 and the plug 270 as well as between the thermal conductor 230 and the drill string 18.

Threaded plug 270 is generally cylindrical, has a central axis 211, an upper end 270*a* opposite a lower end 270*b*, an external cylindrical surface 270*c* coaxial with an internal cylindrical surface 270*d* and with central axis 211, an internal top surface 270*e*, an external shoulder 270*f*, an indentation 270*g*, and a circumferential channel or groove 275. At least a portion of external cylindrical surface 270*c* is threaded (not shown). Internal cylindrical surface 270*d* with internal top surface 270*e* form a pocket or cavity 277 that is coaxial with central axis 211, and extends from internal top surface 270*e* downward to lower end 270*b*. The diameter $D_{270e}$ of internal top surface 270*e* is preferably between 0.25 and 2.0 inches and the height $H_{270d}$ of internal cylindrical surface 270*d* is preferably between 0.25 and 1.0 inch. Internal cylindrical surface 270*d* of threaded plug 270 is coaxial with and approximately aligned with upper internal cylindrical surface 230*d* of conductor 230. Indentation 270*g* allows the threaded plug 270 to be turned and tightened during installation. The groove 275 is disposed on and coaxial with external cylindrical surface 270*c* of threaded plug 270. Threaded plug 270 may be made of any suitable material known in the art, including but not limited to metals.

Referring now to FIGS. 4, 4*a*, and 4*d*, threaded plug 270 is disposed in cavity 215 such that lower end 270*b* of plug 270 is above and in contact with upper end 265*a* of split ring 265, external cylindrical surface 270*c* of plug 270 is threadedly engaged with a portion of outer cylindrical portion 215*c* of cavity 215, and external shoulder 270*f* is in contact with outer shoulder 215*b*. A seal 247 is disposed in groove 275 to seal the internal components from the pressure and fluid of the drilling fluid 32 during operation. In general, seal 247 can be any O-ring seal and/or back up ring known in the art. Though shown with a split ring and threaded plug in the present embodiment, any suitable retention means may be used including, but not limited to, retention rings, locking pins, or friction-based retention means. In an alternative embodiment, the threaded plug 270 is thermally insulating and acts as a thermal barrier, resisting or blocking heat transfer between the thermal conductor 230 and the drill string 18. In this alternative embodiment, the thermally insulating threaded plug 270 may be made from any suitable thermally insulative material known in the art, including by not limited to ceramics, rubber, and polymers, or plug 270 may be coated with a thermally insulative coating.

Figure 5:
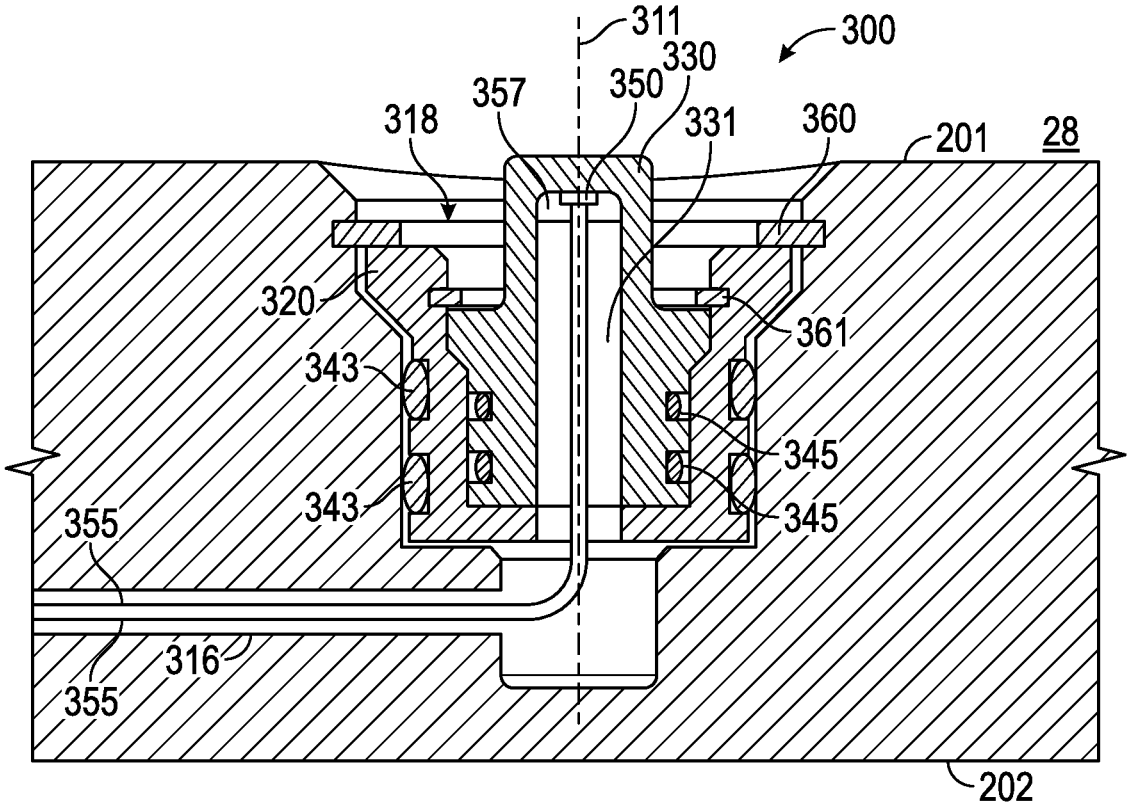
FIG. 5 is an enlarged schematic view of a first alternative outer diameter sensor of the system shown in FIG. 3.
Figure 5A:
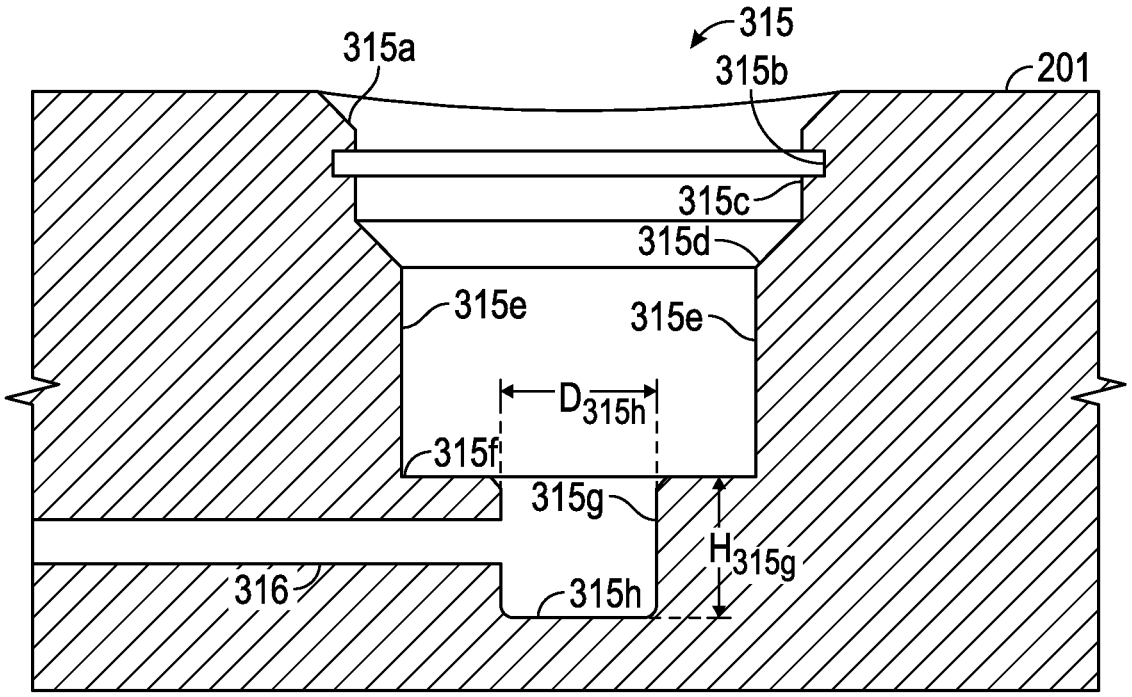
FIG. 5A is an isolated view of a cavity of the outer diameter sensor shown in FIG. 5.

Referring now to FIGS. 5 and 5*a*, showing an enlarged schematic view of a first alternative OD sensor 300 installed in drill string 18. Like numbers are used to designate like parts. Drill string 18 further comprises a bore or cavity 315 that extends from the OD 201 of drill string 18 toward the ID 202 of drill string, where cavity 315 has a central axis coaxial with the central axis 311 of sensor 300. The diameter of cavity 315 generally decreases from the OD 201 toward ID 202 of the drill string 18 and comprises a tapered opening or sloped portion 315*a* that angles radially inward toward central axis 311 and axially downward from OD 201 to channel or groove 315*b*. Upper cylindrical portion 315*c* of cavity 315 extends axially downward from the channel 315*b* toward ID 202 to lower sloped portion 315*d*, which extends radially inward toward central axis 311 and axially downward to middle cylindrical portion 315*e*. Middle cylindrical portion 315*e* extends axially downward from lower sloped portion 315*d* to internal shoulder 315*f*. Lower cylindrical portion 315*g* extends axially from internal shoulder 315*f* to internal bottom surface 315*h*. The diameter $D_{315h}$ of internal bottom surface 315*h* is preferably between 0.25 and 2.0 inches and the height $H_{315g}$ of lower cylindrical portion 315*g* is preferably between 0.25 and 1.0 inch. Due to mechanical properties, these dimensions $D_{315h}$, $H_{315g}$ depend on the type of material used for the drill string 18 body. Drill string 18 further comprises a conduit 316 extending away from lower cylindrical portion 315*g* of cavity 315 toward controller 40.

Figure 5B:
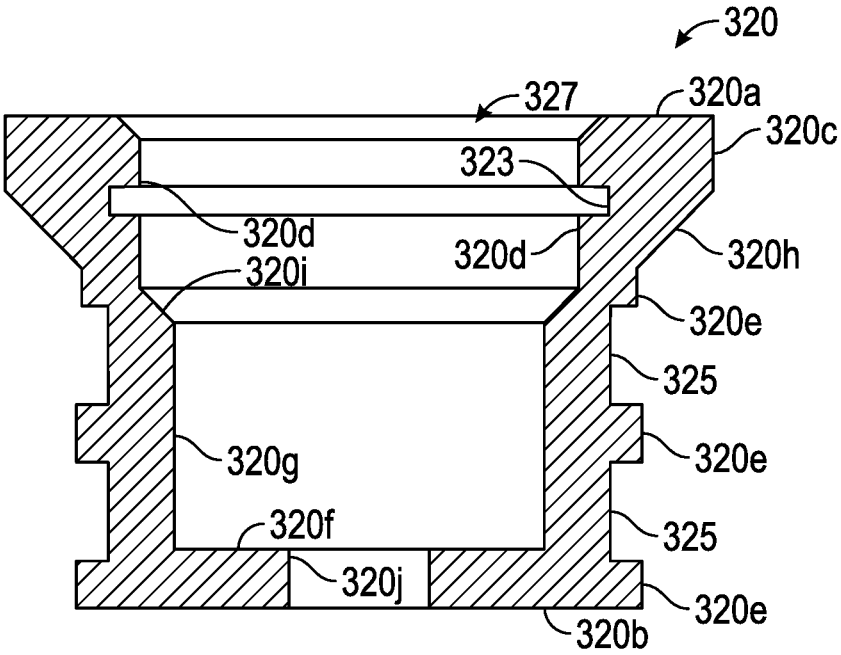
FIG. 5B is an isolated view of an insulator of the outer diameter sensor shown in FIG. 5.

Referring now to FIGS. 5 and 5*b*, sensor 300 comprises a thermal insulator 320, thermal conductor 330, seals 343, 345, 347, a RTD 350, thermally conductive epoxy 357, and retention rings 360, 361. Thermal insulator 320 is generally cylindrical, and includes a central axis 311, an upper end 320*a* opposite a lower end 320*b*, an upper external cylindrical surface 320*c* coaxial with an upper internal cylindrical surface 320*d* and with central axis 311, an outer sloped portion 320*h*, a lower external cylindrical surface 320*e* coaxial with a lower internal cylindrical surface 320*g* and with central axis 311, an inner sloped portion 320*i*, a through hole 320*j* coaxial with central axis 311, an internal shoulder 320*f*, two outer circumferential channels or grooves 325, and an inner circumferential channel or groove 323. Upper external cylindrical surface 320*c* extends axially downward from OD 201 to outer sloped portion 320*h* and upper internal cylindrical surface 320*d* extends axially downward from OD 201 to inner sloped portion 320*i*. The intersection of upper end 320*a* and upper internal cylindrical surface 320*d* may follow any geometry including but not limited to orthogonal, rounded, curved, or slanted (shown). Disposed on and coaxial with internal cylindrical surface 320*d* of thermal insulator 320 is an inner circumferential channel or groove 323.

Outer sloped portion 320*h* angles radially inward toward central axis 311 and axially downward from upper external cylindrical surface 320*c* to lower external cylindrical surface 320*e*, and inner sloped portion 320*i* angles radially inward toward central axis 311 and axially downward from upper internal cylindrical surface 320*d* to lower internal cylindrical surface 320*g*. Lower external cylindrical surface 320*e* extends axially from outer sloped portion 320*h* to lower end 320*b*, and lower internal cylindrical surface 320*g* extends axially from inner sloped portion 320*i* to internal shoulder 320*f*. The two outer circumferential channels or grooves 325, axially spaced apart from each other, are disposed on and coaxial with lower external cylindrical surface 320*e* of thermal insulator 320. Internal shoulder 320*f* extends radially from lower internal cylindrical surface 320*g* to through hole 320*j*. Through hole 320*j* extends axially from internal shoulder 320*f* to lower end 320*b*. Upper internal cylindrical surface 320*d*, inner sloped portion 320*i*, and lower internal cylindrical surface 320*g* form a cavity 327 coaxial with central axis 311 and having a diameter greater than the diameter of through hole 320*j*. Thermal insulator 320 may be made of any suitable thermally insulative material known in the art, including but not limited to ceramics and polymers (e.g., elastomers or thermoplastics).

Thermal insulator 320 is disposed in cavity 315 of the drill string 18 such that lower end 320*b* of insulator 320 is in contact with internal shoulder surface 315*f* of cavity 315, lower external cylindrical surface 320*e* of insulator 320 is sealingly coupled with middle cylindrical portion 315*e* of cavity 315, outer sloped portion 320*h* of insulator 320 is in contact with lower sloped portion 315*d*, and external surface 320*c* of insulator 320 is in contact with upper cylindrical portion 315*c* of cavity 315. The thermal insulator 320 acts as a thermal barrier, resisting or blocking heat transfer from the drill string 18 to the interior or cavity 327 of the thermal insulator 320. A seal 343 is disposed in each groove 325 to seal the internal components from the pressure and fluid of the drilling fluid 32 during operation. In general, seals 343 can be any O-ring seal and/or back up ring known in the art.

Figure 5C:
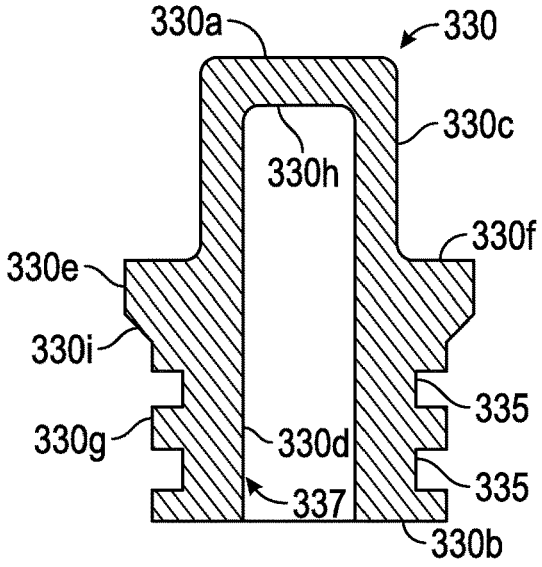
FIG. 5C is an isolated view of a conductor of the outer diameter sensor shown in FIG. 5.

Referring now to FIGS. 5 and 5*c*, thermal conductor 330 is generally cylindrical, and includes a central axis 311, an upper end 330*a* opposite a lower end 330*b*, an upper external cylindrical surface 330*c* coaxial with central axis 311, an internal cylindrical surface 330*d*, a middle external cylindrical surface 330*e*, a lower external cylindrical surface 330*g*, a sloped outer portion 330*i*, an internal top surface 330*h*, an external shoulder 330*f*, and two circumferential channels or grooves 335. Upper external surface 330*c* extends axially downward from upper end 330*a* to external shoulder 330*f*. The intersection of upper end 330*a* and upper external cylindrical surface 330*c* may follow any geometry including but not limited to orthogonal, curved, slanted, or rounded (shown). External shoulder 330*f* extends radially outward from upper external cylindrical surface 330*c* to middle external cylindrical surface 330*e*. Middle external cylindrical surface 330*e* extends axially downward from external shoulder 330*f* to sloped outer portion 330*i*. Sloped portion 330*i* angles radially inward toward central axis 311 and extends axially downward from middle external cylindrical surface 330*e* to lower external cylindrical surface 330*g*. Lower external cylindrical surface 330*g* extends axially downward from sloped outer portion 330*i* to lower end 330*b*.

Middle external surface 330*e* has a diameter greater than the diameter of upper external surface 330*c*, lower external surface 330*g*, and internal surface 330*d*. Internal surface 330*d* with internal top surface 330*h* form a cavity or inner bore 337 that is coaxial with central axis 311, and extends from internal top surface 330*h* downward toward lower end 330*b*. The two grooves 335, axially spaced apart from each other, are disposed on and coaxial with the lower external surface 330*g* of thermal conductor 330. Thermal conductor 330 may be made of any suitable thermally conductive material known in the art, including but not limited to metals. The thermal conductance of the thermal conductor 330 material is preferably higher than the thermal conductance of the main tool body. Furthermore, the thickness of the upper end 330*a* of conductor 330 to the internal top surface 330*h* can be adjusted based on the erosion testing results of the material selected for the conductor 330. Materials more resistant to erosion may allow for a thinner upper end 330*b* of conductor 330. The thinner the upper end 330*a* can be, the less time it will take to see the accurate temperature reading. Further, the more surface area that can be provided by the thermal conductor 330 to be in contact with the drilling fluid 32*b*, the more the drilling fluid 32*b* flow can affect the sensor's reading.

Referring now to FIGS. 5, 5*b*, and 5*c*, thermal conductor 330 is coupled to thermal insulator 320 such that external shoulder 330*f* of conductor 330 is in contact with lower end 320*b* of insulator 320, lower external cylindrical surface 330*g* of conductor 330 is sealingly coupled to the lower internal cylindrical surface 320*g* of insulator 320, sloped outer portion 330*i* of conductor 330 is in contact with inner sloped portion 320*i* of insulator 320, and middle external cylindrical surface 320*e* of conductor 330 is in contact with upper internal cylindrical surface 320*d*. The thermal insulator 320 acts as a thermal barrier, resisting or blocking heat transfer between the drill string 18 and thermal conductor 330. A seal 345 is disposed in each groove 335 to seal the internal components from the pressure and fluid of the drilling fluid 32 during operation. In general, seals 345 can be any O-ring seal and/or back up ring known in the art. Further, through hole 320*j* of insulator 320 may be flush with internal cylindrical surface 330*d* of conductor 330, but need not be.

Referring still to FIG. 5, an RTD 350 is adhered to the internal top surface 330*h* of conductor 330 with thermally conductive epoxy 357. A thermal conduction path is formed between the drilling fluid 32*b* and the RTD 350 through the thermal conductor 330 and the thermally conductive epoxy 357. Epoxy 357 allows sensor 300 to withstand vibrations of the drill string 18 during operations; further strain relief may be added to the RTD 350 using a potting. The thermal epoxy 357 further allows the RTD 350, via the conductor 330, to respond quickly to changes in drilling fluid 32*b* temperature. The RTD 350 comprises leads or wires 355, which are routed through inner bore 337 of the thermal conductor 330 forming a hollow annulus 331 between the wires 355 and the thermal conductor internal cylindrical surface 330*d*, then through bore 320*j* of insulator 320, through lower cylindrical portion 315*g* of cavity 315, and then into the conduit 316. The RTD wire 355 is in communication with controller 40.

Referring now to FIGS. 5, 5*a*-5*c*, retention ring 360 is disposed in and extends radially inward beyond groove 315*b* of cavity 315; retention ring 360 is also disposed above and in contact with top end 320*a* of insulator 320 to retain insulator 320 in cavity 315. Retention ring 361 is disposed in and extends radially inward beyond groove 323 of insulator 320; retention ring 361 is also disposed above and in contact with external shoulder 330*f* of conductor 330 to retain conductor 330 in cavity 327 of insulator 320. Though shown with retention rings in the present embodiment, any suitable retention means may be used including, but not limited to, threaded components, locking pins, or friction-based retention means.

A circular channel 318 is formed with sloped portion 315*a* and upper cylindrical portion 315*c* of cavity 315, retention rings 360, 361, and upper end 320*a* and upper internal cylindrical surface 320 of insulator 320 comprising the channel's outer sides. The conductor's external shoulder 330*f* defines the channel's bottom. The conductor's upper external cylindrical surface 330*c* defines the channel's inner side. Further, upper end 330*a* of conductor 330 may protrude beyond the surface of OD 201 of drill string 18; upper end 330*a* more preferably is flush with or below the OD 201 of drill string 18. During operation, the drilling fluid 32*b* flowing up the annulus 28 or outer diameter of the borehole 26 up the outer diameter 202 of the drill string 18 flows into and around channel 318 as well as over upper end 330*a* of conductor 330. The channel 318 and protruding upper end 330*a* of conductor 330 provides an increased surface area for the drilling fluid 32*b* to contact on the conductor 330 and subsequently, the RTD 350. The increased surface area allows the RTD 350, via the conductor 330, to respond quickly to changes in drilling fluid 32*b* temperature. Further, the small profile of the conductor 330 minimizes the amount of conductor material and in addition to the insulation (i.e., insulator 320) surrounding the conductor 330, prevents the dissipation of heat from the drilling fluid 32*b* to the rest of the drill string component 18.

Figure 6:
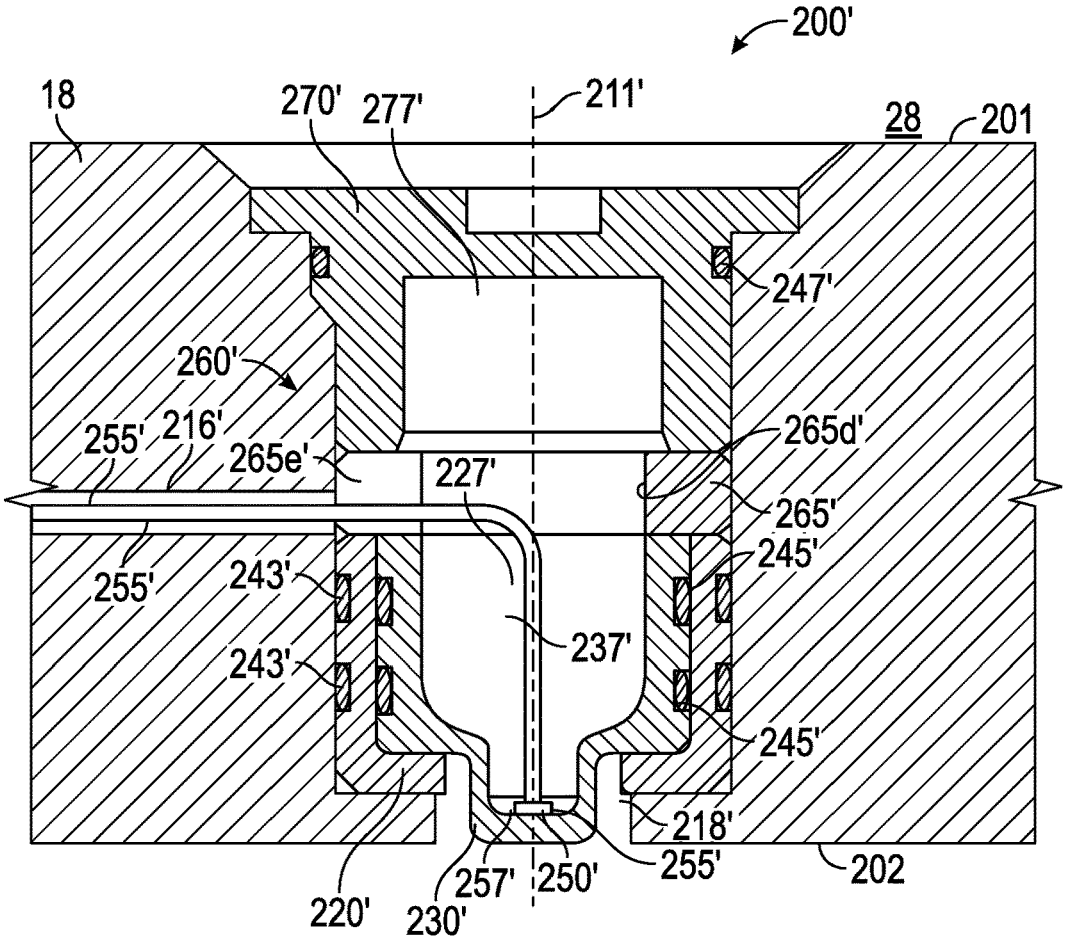
FIG. 6 is an enlarged schematic view of a second alternative inner diameter sensor of the system shown in FIG. 3.
Figure 6A:
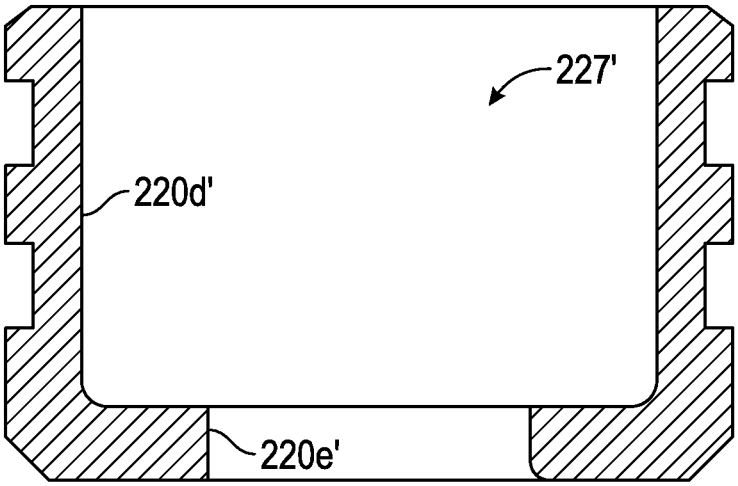
FIG. 6A is an isolated view of an insulator of the second alternative inner diameter sensor shown in FIG. 6.
Figure 6B:
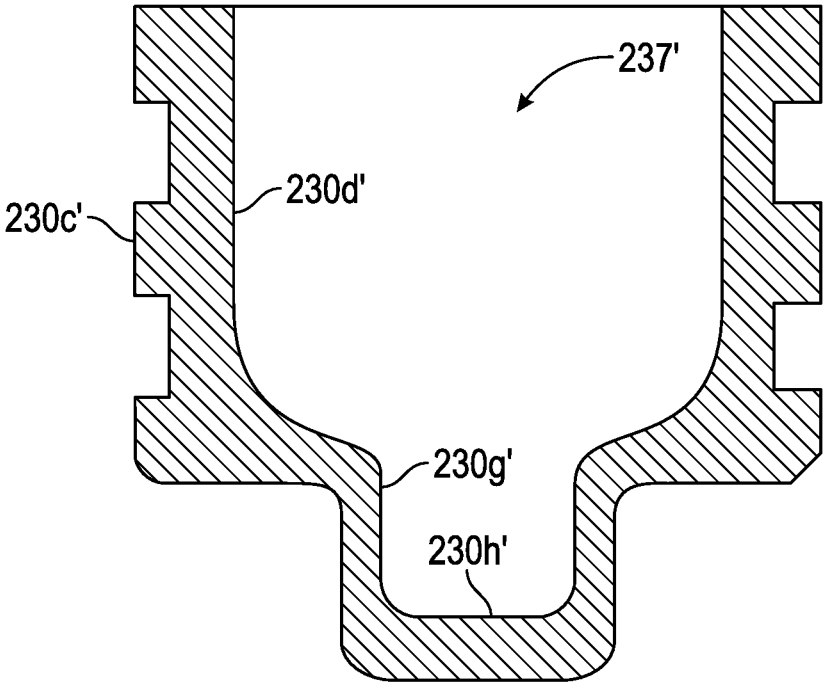
FIG. 6B is an isolated view of a conductor of the second alternative inner diameter sensor shown in FIG. 6.

Referring now to FIGS. 6, 6*a*, and 6*b*, showing an enlarged schematic view of a second alternative ID sensor 200' installed in drill string 18. Like numbers are used to designate like parts. The second alternative ID sensor 200' comprises the same components as those of first alternative ID sensor 200 shown in FIG. 4. However, the diameters of cavities 227', 237', 277' in the insulator 220', conductor 230', and threaded plug 270', respectively, and the width of passage 265*e'* of split ring 265' in sensor 200' are larger than the diameters of cavities 227, 237, 277 in the insulator 220, conductor 230, and threaded plug 270, respectively, and the width of passage 265*e* of split ring 265 in the first alternative ID sensor 200.

More specifically, the internal cylindrical surface 220*d'* and through hole 220*e'* have enlarged diameters. Further, upper external cylindrical surface 230*c'* and upper internal cylindrical surface 230*d'* have enlarged diameters while the diameters of lower external cylindrical surface 230*e'* and lower internal cylindrical surface 230*g'* remain the same as the diameters of corresponding surfaces (lower external cylindrical surface 230*e*, lower internal cylindrical surface 230*g*, respectively) of the first alternative ID sensor 200. Thus, the internal cylindrical surfaces 230*d'*, 230*g'* with internal bottom surface 230*h'* form a larger cavity 237' that is coaxial with central axis 211'; and upper internal cylindrical surface 230*d'* flares outward to a greater extent from lower internal cylindrical surface 230*g'*. Internal surface 265*d'* of split ring 265' also has a wider opening to align with the larger diameter of upper internal cylindrical surface 230*d'*, and internal cylindrical surface 270*d'* of threaded plug 270' has a larger diameter forming a larger cavity 277'. These larger cavities 237', 277' are filled with air, which provide an insulating effect, helping to further prevent the dissipation of heat from the drilling fluid 32*a* to the rest of the drill string component 18. Thus, cavities 237', 277' act as a thermal barrier, resisting or blocking heat transfer between the thermal conductor 230' and the drill string 18.

Figure 7:
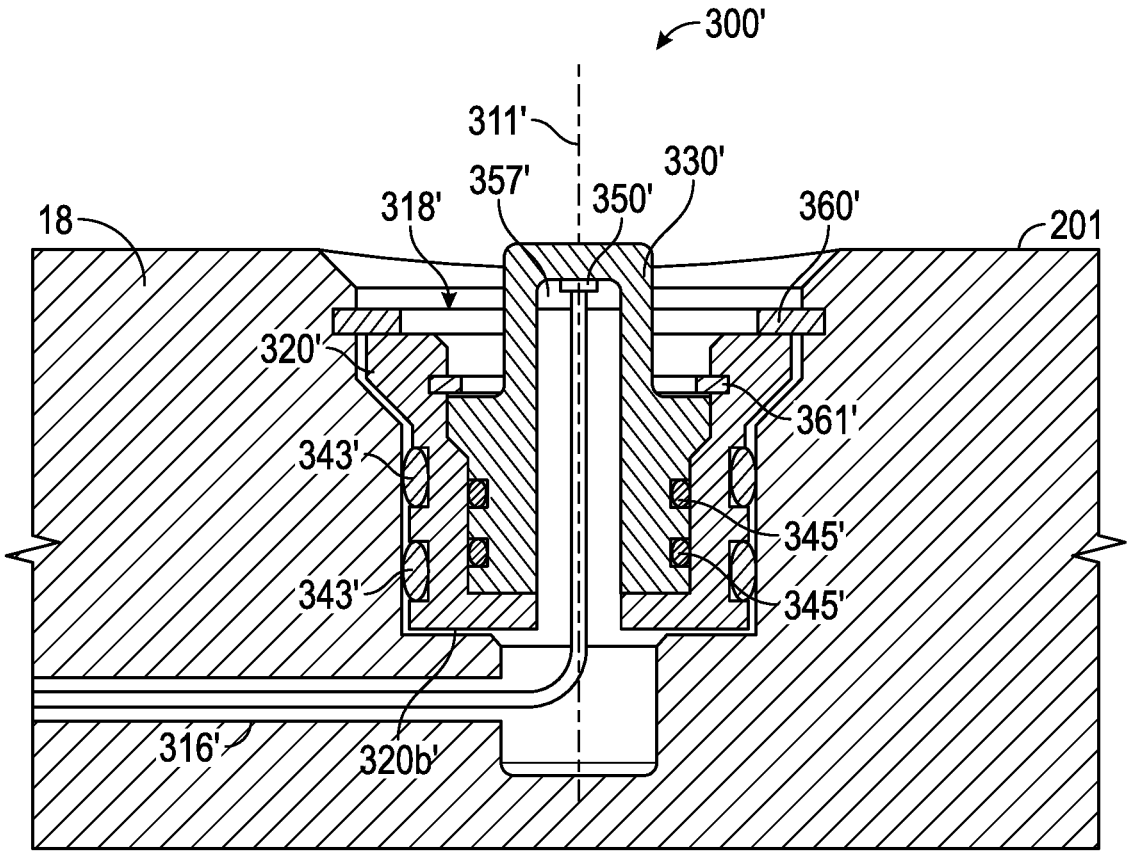
FIG. 7 is an enlarged schematic view of a second alternative outer diameter sensor of the system shown in FIG. 3.
Figure 7A:
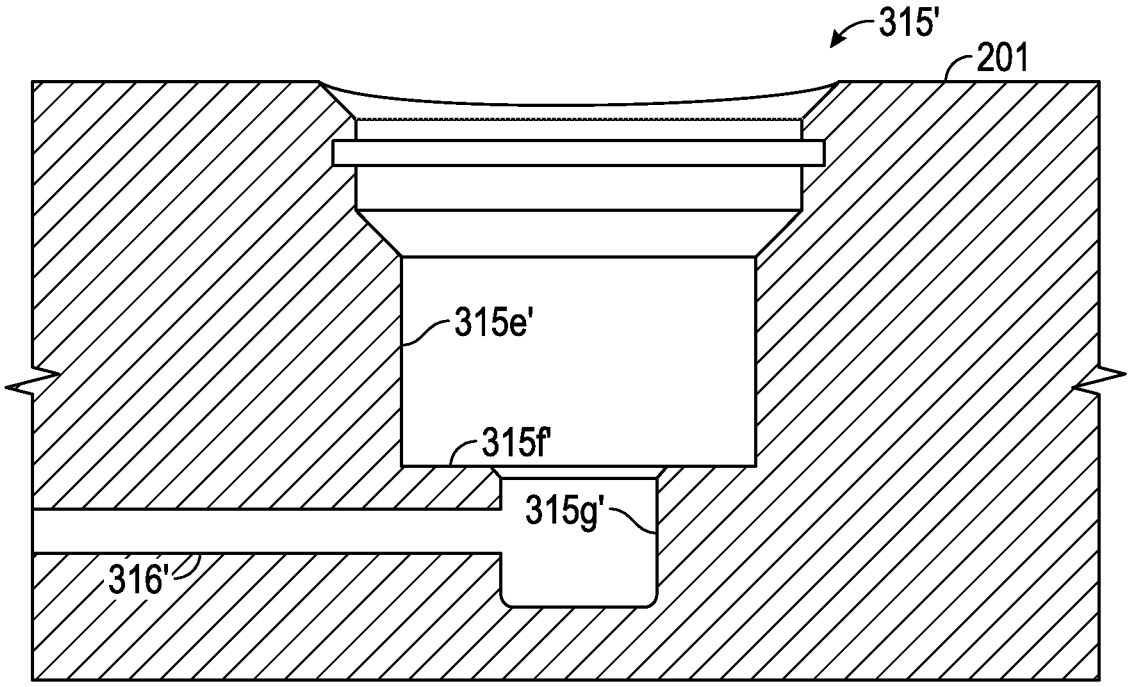
FIG. 7A is an isolated view of a cavity of the second alternative outer diameter sensor shown in FIG. 7.

Referring now to FIGS. 7 and 7*a*, an enlarged schematic view of a second alternative OD sensor 300' installed in drill string 18 is shown. Like numbers are used to designate like parts. The second alternative OD sensor 300' comprises the same components as those of first alternative OD sensor 300 shown in FIG. 5 with insulator 320' and conductor 330' being the same as insulator 320 and conductor 330, respectively. However, the diameter of cavity 315', specifically the diameter of lower cylindrical portion 315*g'* of cavity 315', is larger than the diameter of corresponding cavity 315*g* of cavity 315 in the first alternative OD sensor 300. Further, as the diameter of lower cylindrical portion 315*g'* of cavity 315' is larger while the diameter of the middle cylindrical portion 315*e'* of cavity 315' remains unchanged, the length of internal shoulder surface 315*f'* is shortened and the insulator lower end 320*b'* extends a greater amount beyond lower cylindrical portion 315*g'* of cavity 315'. This larger cavity (portion 315*g'* of cavity 315') is filled with air, which provides an insulating effect, helping to further prevent the dissipation of heat from the drilling fluid 32*b* to the rest of the drill string component 18. Thus, cavity 315' acts as a thermal barrier, resisting or blocking heat transfer between the thermal conductor 330' and the drill string 18.

Figure 8:
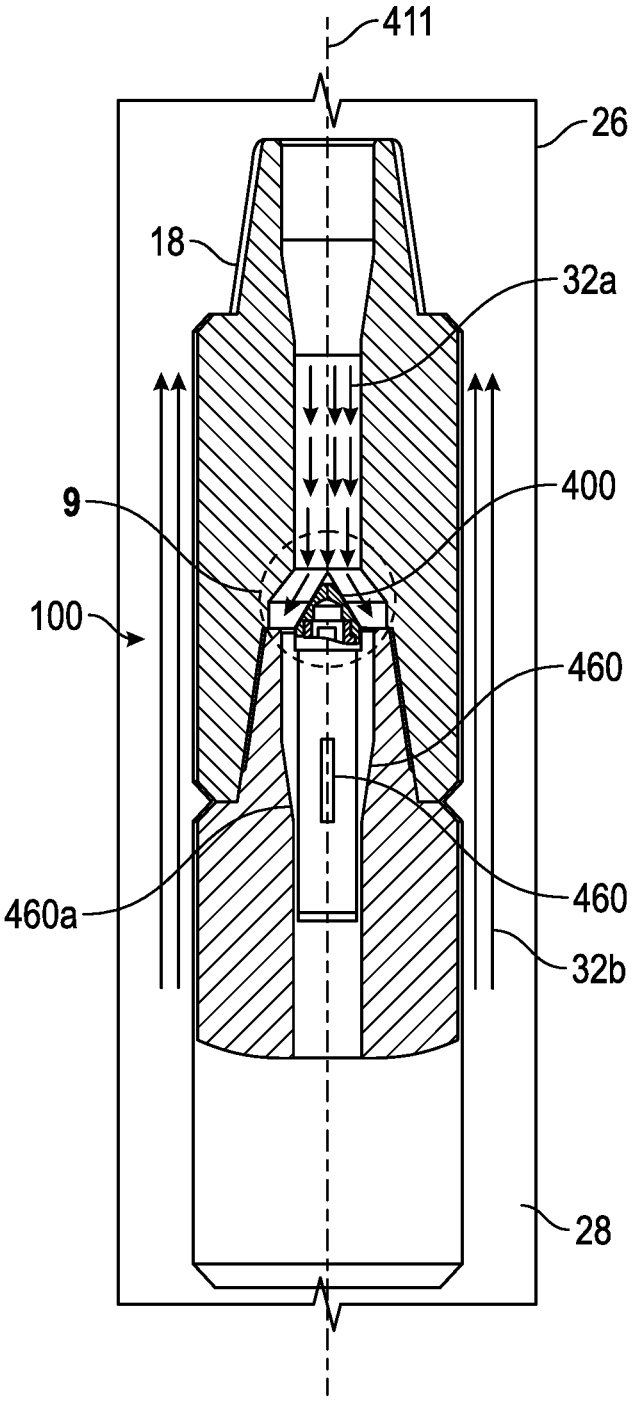
FIG. 8 is an enlarged partial cross-sectional schematic view of a portion of a second embodiment of the system shown in FIG. 1.
Figure 9:
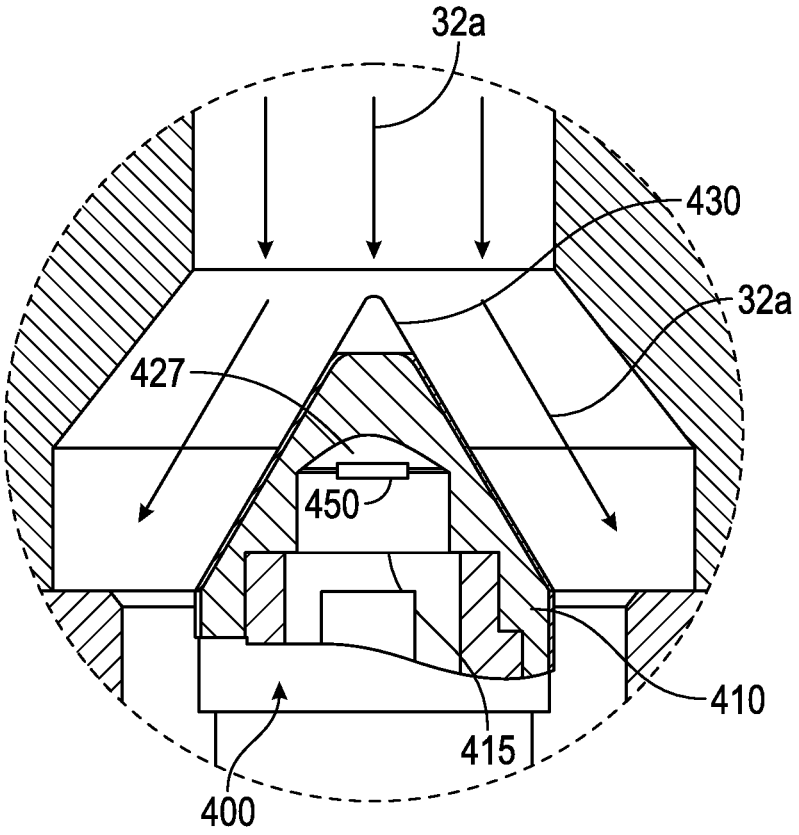
FIG. 9 is an enlarged schematic view of a portion of the system shown in FIG. 8.

Referring now to FIGS. 8 and 9, FIG. 8 shows an enlarged schematic view of a portion of a second embodiment of the drill string 18 of drilling system 10 shown in FIG. 1 having sensor assembly 100. FIG. 9 shows an enlarged view of section 9 depicted in FIG. 8 and includes sensor assembly 100 having an ID sensor 400 with central axis 411. The sensor assembly 100 comprises a housing 410, a cavity 415, cap 430, an RTD 450, and epoxy 427. RTD 450 is configured to measure the temperature of drilling fluid 32*a* flowing down the inner diameter of the drill string 18 ("ID sensor 400") as shown in the present embodiment. Further, more than one sensor assembly 100 may be employed in a drilling system 10 at various locations to measure the temperature of the drilling fluid 32*a* at different locations within the drill string 18.

Central axis 411 is coaxial to the central axis 11 of the drill string 18. Housing 410 comprises a cavity 415, a cap 430, and stabilizers 460 (see FIG. 8). RTD 450 is adhered to the internal upper surface of cavity 415 with thermally conductive epoxy 427. Epoxy 427 allows sensor 400 to withstand vibrations of the drill string 18 during operations; further strain relief may be added to the RTD 450 using a potting. The thermal epoxy 427 further allows the RTD 450, via the housing 410, to respond quickly to changes in drilling fluid 32*a* temperature. The RTD 450 comprises leads or wires (not shown), which are routed down through the bottom of housing 410 and is communicatively connected to controller 40.

Housing 410 is secured within drill string 18 via stabilizers 460, shown in FIG. 8 as a fin structure with a tapered outer surface 460*a*. Though shown as having a fin-like structure, stabilizers 460 may follow any suitable geometry. Housing 410 may be made of any suitable material known in the art, including but not limited to metals. For example, housing 410 may be steel with a coating to prevent erosion.

During operation, the drilling fluid 32*a* flowing down the inner diameter 402 of the drill string 18 flows past cap 430 and housing 410, and subsequently, RTD 450. The conical shape of the housing cap 430 provides an increased surface area for the drilling fluid 32*a* to contact on the RTD 450. The increased surface area allows the RTD 450, via the housing 410, to respond quickly to changes in drilling fluid 32*a* temperature.

Figure 10B:
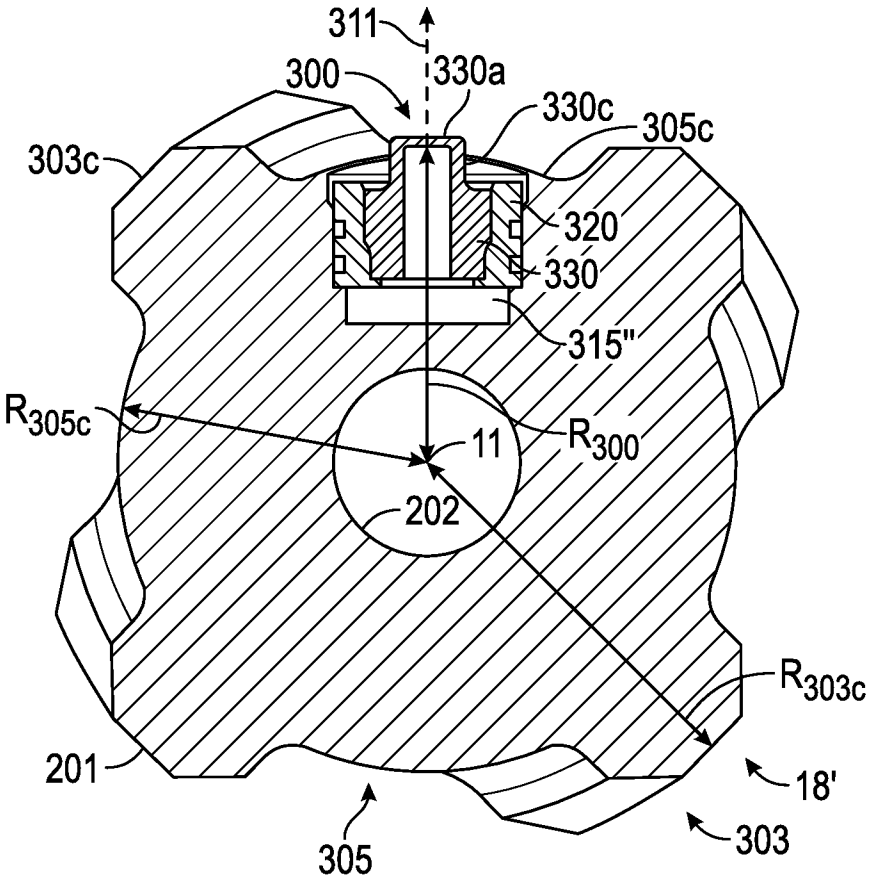
FIG. 10B is an enlarged schematic view of the embodiment shown in FIG. 10A.
Figure 10A:
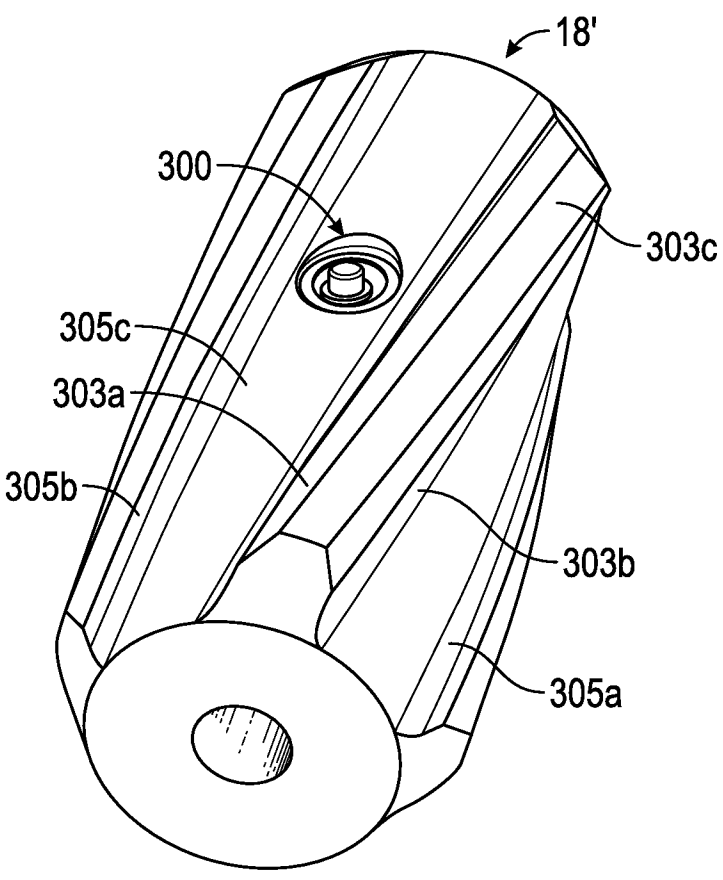
FIG. 10A is an enlarged schematic top view of a portion of an alternative embodiment of the system shown in FIG. 3.
Figure 10C:
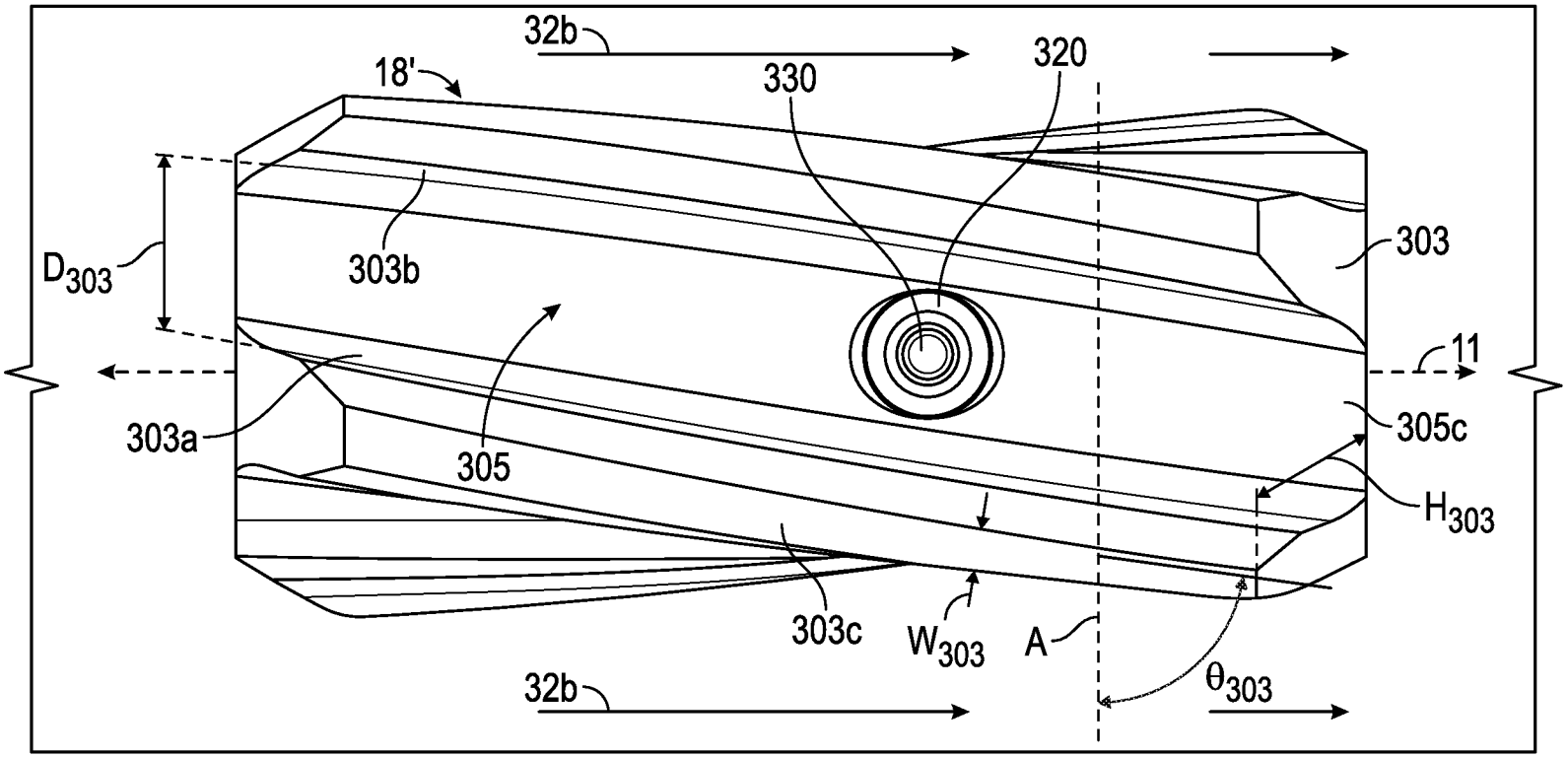
FIG. 10C is an enlarged schematic side view of the embodiment shown in FIG. 10A.

Referring now to FIGS. 10*a*-10*c*, various enlarged schematic views of an alternative embodiment of the OD sensor 300 installed in drill string 18' are shown. Like numbers are used to designate like parts. In this alternative embodiment, the OD sensor 300 comprises the same components as those of the first and second alternative OD sensors 300, 300' shown in FIGS. 5 and 6, respectively, with insulator 320 and conductor 330 being the same as insulator 320, 320', respectively, and conductor 330, 330', respectively. Further, drill string 18' comprises a plurality of circumferentially-spaced parallel ridges 303 separated by channels or passages 305, the ridges 303 and corresponding channels 305 extend helically about axis 11 and axially along the drill string 18'. In this embodiment, drill string 18' includes four uniformly circumferentially-spaced ridges 303. However, in general, the drill string 18' can include any suitable number of ridges 303, and further, the circumferential spacing of the ridges 303 can be uniform or non-uniform.

Each ridge 303 has a first side wall 303*a*, a second side wall 303*b*, and a radially outer generally cylindrical surface 303*c*. Each passage 305 has a first side wall 305*a*, a second side wall 305*b*, and a bottom surface 305*c*. The first ridge side wall 303*a* is coincident with first channel side wall 305*a* and the second ridge side wall 303*b* is coincident with second channel side wall 305*b*. Radially outer surface 303*c* of each ridge 303 is disposed at a uniform radius $R_{303c}$, and each ridge 303 has a height $H_{303}$ measured radially from radially outer surface 303*c* to bottom surface 305*c*, which has a uniform radius $R_{305c}$. The ridges 303 are spaced a distance $D_{303}$ apart measured from a first side wall 303*a* to a second side wall 303*b*, and oriented at an angle $\theta_{303}$ relative to a reference plane A perpendicular to axis 11 in side view (see FIG. 10*c*). In other embodiments, the radius $R_{303c}$ of the radially outer surface 303*c* and the radius $R_{305c}$ of the bottom surface 305*c* may be non-uniform within a singular ridge 303 or channel 305, respectively, and/or may be non-uniform between ridges 303 or channels 305.

Drill string 18' further comprises a bore or cavity 315" that extends from the bottom groove surface 305*c* toward the ID 202 of drill string 18', where cavity 315" has a central axis coaxial with the central axis 311 of sensor 300. In this alternative embodiment, the characteristics of the cavity 315" are similar to those of the cavity 315, 315' in other embodiments described herein and configured similarly to house and engage the components of the OD sensor 300. The quantity of ridges 303 and corresponding channels 305 as well as the distance $D_{303}$ between ridges 303 is configured such that the cavity 315" is disposed within groove bottom surface 305*c* between the first and second ridge sides 303*a*, 303*b*, respectively. As in prior embodiments, when OD sensor 300 having a uniform radius $R_{300}$ is disposed in cavity 315", an upper end 330*a* of conductor 330 protrudes radially beyond the bottom surface 305*c* of groove 305 having radius $R_{305c}$ of drill string 18'. However, the upper end 330*a* of conductor 330 does not extend radially beyond radially outer ridge surface 303*c* having radius $R_{303c}$. Thus, the radius $R_{303c}$ of the ridge 303*c* is greater than the radius $R_{300}$ of the OD sensor 300, which is greater than the radius $R_{305c}$ of the bottom channel surface 305*c*. In other embodiments, upper conductor end 330*a* may be flush with or below the bottom surface 305*c* of drill string 18'. In such embodiments, the radius $R_{303c}$ of the ridge 303*c* is greater than the radius $R_{305c}$ of the bottom channel surface 305*c*, which is either approximately equal to or greater than the radius $R_{300}$ of the OD sensor 300.

During operation, drilling fluid 32*b* flowing up the annulus 28 or outer diameter of the borehole 26 up the OD 202 of the drill string 18' flows over conductor upper end 330*a*, into channel 318 (see FIG. 5), and around upper external cylindrical surface 330*c* of conductor 330. By locating the OD sensor 300 in the bottom surface 305*c* of the groove, while the drilling fluid 32*b* flows up the annulus 28, a portion of the drilling fluid 32*b* enters and flows upward within channels 305. The drilling fluid 32*b* then flows over and around the OD sensor 300 and because channels 305 are generally oriented along the same direction as the flow of the drilling fluid 32*b*, the fluid 32*b* can continue to flow past OD sensor 300 through channel 305 and not become packed around the conductor 330. The channels 305 provide a gap or space that allows the drilling fluid 32*b* and cuttings to flow past the cavity 315 with OD sensor 300 while protecting the OD sensor 300 from coming in direct contact with the wall of the borehole 26. The passage 305 acts as a self-cleaning mechanism for the OD sensor 300 by creating a path for the drilling fluids 32*b* to pass through. Specifically, the channels 305 allow the OD sensor 300 (with a radius $R_{300}$ less than the radius $R_{303c}$ of the ridge 303) to protrude into the drilling fluid 32*b* flowing up the annulus 28 while remaining within the gage diameter of drill string 18' based on the radius $R_{303c}$ of the ridge 303, which is larger than the radius $R_{300}$ of OD sensor 300. The drilling fluid 32*b* can flow across the OD sensor 300 without becoming packed around OD sensor 300 to provide realistic temperature measurements of the drilling fluid 32*b*.

Exemplary embodiments are described herein, though one having ordinary skill in the art will recognize that the scope of this disclosure is not limited to the embodiments described, but instead by the full scope of the following claims. The claims listed below are supported by the principles described herein, and by the various features illustrated which may be used in desired combinations.

What is claimed is:

1. A temperature sensing device for determining downhole fluid temperature at a drill string in a borehole, the device comprising:

a thermal insulator received in a cavity of the drill string;

a thermal conductor received in the thermal insulator;

a temperature sensor received in the thermal conductor and disposed adjacent a first opening in the cavity; and a thermally insulating plug received in a second opening in the cavity, wherein the thermally insulating plug is configured to retain the thermal insulator and the thermal conductor in the cavity;

wherein the thermal insulator is configured to provide a first thermal barrier between the thermal conductor and the drill string and the thermally insulating plug is configured to provide a second thermal barrier between the thermal conductor and the drill string.

2. The device of claim 1 further comprising a thermally insulating ring disposed between the plug and the thermal conductor.

3. The device of claim 2 wherein the thermally insulating ring is disposed in the cavity such that the cavity is separated into a first sensor portion and a second portion.

4. The device of claim 3 wherein the thermal conductor extends from the first opening through the first sensor portion of the cavity to the thermally insulating ring in the cavity.

5. The device of claim 4 further comprising a thermal conduction path to the temperature sensor disposed only in the first portion of the cavity.

6. The device of claim 1 wherein the thermal conductor includes an inner bore with an inner surface, and the inner bore includes a sensor wire extending through the inner bore with a hollow annulus between the sensor wire and the inner surface.

7. The device of claim 1, wherein the temperature sensing device is disposed in a channel on the drill string and within an outer diameter of the drill string.

8. The device of claim 1, further comprising an inner cavity portion disposed closer to a central axis of the drill string than the thermal insulator and the thermal conductor.

9. The device of claim 8 wherein the inner cavity portion is configured to provide a third thermal barrier between the thermal conductor and the drill string.

10. The device of claim 8 wherein the inner cavity portion forms an inner chamber with an inner bore of the thermal conductor through a hole in the thermal insulator.

11. The device of claim 10 wherein the inner bore includes an inner surface, and the inner bore includes a sensor wire extending through the inner bore with a hollow annulus between the sensor wire and the inner surface.

12. The device of claim 8 further comprising a thermal conduction path to the temperature sensor disposed outside of the inner cavity portion.

13. The device of claim 8, wherein the device is disposed in a channel on the drill string and within an outer diameter of the drill string.

14. A temperature sensing system for determining downhole fluid temperature at a drill string in a borehole, the system comprising:

a drill string comprising a cavity; and a temperature sensing device, comprising:

a thermal insulator receivable in a cavity of the drill string;

a thermal conductor receivable in the thermal insulator;

a temperature sensor receivable in the thermal conductor whereby the temperature sensor is disposed adjacent a first opening in the cavity when the temperature sensor is received in the thermal conductor, the thermal conductor is received in the thermal insulator, and the thermal insulator is received in the cavity of the drill string; and a thermally insulating plug receivable in a second opening in the cavity, wherein the thermally insulating plug is configured to retain the thermal insulator and the thermal conductor in the cavity;

wherein the thermal insulator is configured to provide a first thermal barrier between the thermal conductor and the drill string and the thermally insulating plug is configured to provide a second thermal barrier between the thermal conductor and the drill string.

15. The system of claim 14 further comprising a thermally insulating ring receivable between the plug and the thermal conductor.

16. The system of claim 15 wherein the thermally insulating ring is receivable in the cavity such that the cavity is separated into a first sensor portion and a second portion whereby the thermal conductor extends from the first opening through the first sensor portion of the cavity to the thermally insulating ring in the cavity.

17. The system of claim 16 further comprising a thermal conduction path to the temperature sensor disposed only in the first portion of the cavity.

18. The system of claim 14 wherein the thermal conductor includes an inner bore with an inner surface, and the inner bore includes a sensor wire extending through the inner bore with a hollow annulus between the sensor wire and the inner surface.

19. The system of claim 14, further comprising an inner cavity portion disposed closer to a central axis of the drill string than the thermal insulator and the thermal conductor, wherein the inner cavity portion is configured to provide a third thermal barrier between the thermal conductor and the drill string.

20. The system of claim 19 wherein the inner cavity portion forms an inner chamber with an inner bore of the thermal conductor through a hole in the thermal insulator, and wherein the inner bore includes an inner surface, and the inner bore includes a sensor wire extending through the inner bore with a hollow annulus between the sensor wire and the inner surface.

* * * * *